US009472839B2

(12) United States Patent
Kato et al.

(10) Patent No.: US 9,472,839 B2
(45) Date of Patent: Oct. 18, 2016

(54) HIGH-FREQUENCY TRANSMISSION LINE AND ELECTRONIC DEVICE

(71) Applicant: Murata Manufacturing Co., Ltd., Nagaokakyo-shi, Kyoto-fu (JP)

(72) Inventors: Noboru Kato, Nagaokakyo (JP); Masahiro Ozawa, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 178 days.

(21) Appl. No.: 14/306,264

(22) Filed: Jun. 17, 2014

(65) Prior Publication Data

US 2014/0292450 A1 Oct. 2, 2014

Related U.S. Application Data

(63) Continuation of application No. PCT/JP2012/083967, filed on Dec. 27, 2012.

(30) Foreign Application Priority Data

Jan. 6, 2012 (JP) ..... 2012-000987

(51) Int. Cl.
*H01P 3/08* (2006.01)
*H01P 3/00* (2006.01)

(52) U.S. Cl.
CPC ..... *H01P 3/08* (2013.01); *H01P 3/003* (2013.01); *H01P 3/085* (2013.01)

(58) Field of Classification Search
CPC ..... H01P 3/08; H01P 3/081; H01P 3/082; H01P 3/084; H01P 3/085
USPC ..... 333/238, 33, 1, 4, 5
See application file for complete search history.

(56) References Cited

U.S. PATENT DOCUMENTS

| | | | |
|---|---|---|---|
| 6,522,214 | B1 | 2/2003 | Harju et al. |
| 2007/0241837 | A1 | 10/2007 | Kamitsuna |

FOREIGN PATENT DOCUMENTS

| | | | |
|---|---|---|---|
| EP | 2 456 005 | A1 | 5/2012 |
| JP | 2003-502973 | A | 1/2003 |
| JP | 2006-157646 | A | 6/2006 |
| JP | 2011-071403 | A | 4/2011 |
| WO | 2006/095729 | A1 | 9/2006 |
| WO | 2011/007660 | A1 | 1/2011 |

OTHER PUBLICATIONS

Official Communication issued in corresponding Japanese Patent Application No. 2013-552423, mailed on Jan. 13, 2015.
Official Communication issued in International Patent Application No. PCT/JP2012/083967, mailed on Apr. 2, 2013.

*Primary Examiner* — Stephen E Jones
(74) *Attorney, Agent, or Firm* — Keating & Bennett, LLP

(57) ABSTRACT

A high-frequency transmission line includes a laminate including dielectric layers, a first signal line provided on one of the dielectric layers, a second signal line crossing the first signal line when viewed in a plan view in a direction of lamination, the second signal line being positioned on the same dielectric layer as the first signal line except for a crossing portion that crosses with the first signal line, and an intermediate ground conductor provided between the first and second signal lines in the direction of lamination, so as to overlap with crossing portions of the first and second signal lines when viewed in a plan view in the direction of lamination.

13 Claims, 19 Drawing Sheets

HIGH-FREQUENCY TRANSMISSION LINE AND ELECTRONIC DEVICE

This application is based on Japanese Patent Application No. 2012-000987 filed on Jan. 6, 2012, and International Application No. PCT/JP2012/083967 filed on Dec. 27, 2012, the entire content of each of which is incorporated herein by reference.

BACKGROUND OF THE INVENTION

1. Field of the Invention

The present invention relates to high-frequency transmission lines and electronic devices, more particularly to a high-frequency transmission line for use in high-frequency signal transmission and an electronic device including the same.

2. Description of Related Art

As inventions relevant to conventional high-frequency transmission lines, signal lines described in, for example, International Patent Publication WO 2011/007660 and Japanese Patent Laid-Open Publication No. 2011-71403 are known. Each of these signal lines includes a laminate, a signal line, and two ground conductors.

The laminate is formed by laminating a plurality of flexible insulator layers. The signal line is provided in the laminate. The signal line is positioned between the two ground conductors in the direction of lamination. Accordingly, the signal line and the two ground conductors form a stripline structure. The signal lines described in International Patent Publication WO 2011/007660 and Japanese Patent Laid-Open Publication No. 2011-71403 are formed by laminates, and therefore, are thinner than the diameter of a typical coaxial cable. Accordingly, they can be disposed in a narrow space within an electronic device.

Incidentally, in some cases, it is desired to cross two signal lines such as those described in International Patent Publication WO 2011/007660 and Japanese Patent Laid-Open Publication No. 2011-71403. However, crossing two signal lines results in two laminates overlapping at a crossing portion of the two signal lines, hence a significantly increased thickness at the crossing. On the other hand, it is conceivable to provide two signal lines in a single laminate, so as to cross each other within the laminate. This results in a reduced thickness at a crossing portion of two signal lines in a laminate, but crosstalk occurs between the signal lines because the signal lines are opposed to each other.

SUMMARY OF THE INVENTION

A high-frequency transmission line according to a preferred embodiment of the present invention includes a laminate including a plurality of dielectric layers, a first signal line provided on one of the dielectric layers, a second signal line crossing the first signal line when viewed in a plan view in a direction of lamination, the second signal line being positioned on the same dielectric layer as the first signal line except for a crossing portion that crosses with the first signal line, and an intermediate ground conductor provided between the first and second signal lines in the direction of lamination, so as to overlap with crossing portions of the first and second signal lines when viewed in a plan view in the direction of lamination.

An electronic device according to another preferred embodiment of the present invention includes a high-frequency transmission line and a housing accommodating the high-frequency transmission line. The high-frequency transmission line includes a laminate including a plurality of dielectric layers, a first signal line provided on one of the dielectric layers, a second signal line crossing the first signal line when viewed in a plan view in a direction of lamination, the second signal line being positioned on the same dielectric layer as the first signal line except for a crossing portion that crosses with the first signal line, and an intermediate ground conductor provided between the first and second signal lines in the direction of lamination, so as to overlap with crossing portions of the first and second signal lines when viewed in a plan view in the direction of lamination.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, a high-frequency transmission line according to various preferred embodiments of the present invention, along with an electronic device including the high-frequency transmission line, will be described with reference to the drawings.

Figure 1:
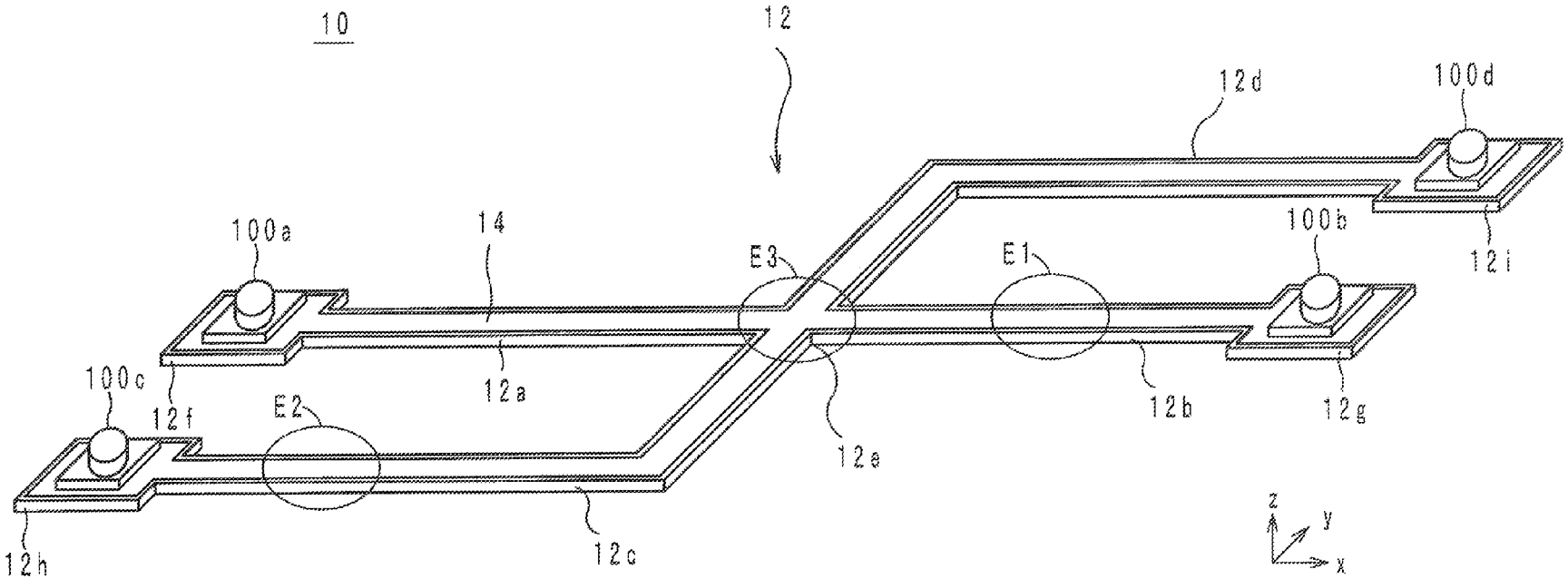
FIG. 1 is an external oblique view of a high-frequency transmission line according to a preferred embodiment of the present invention.
Figure 2:
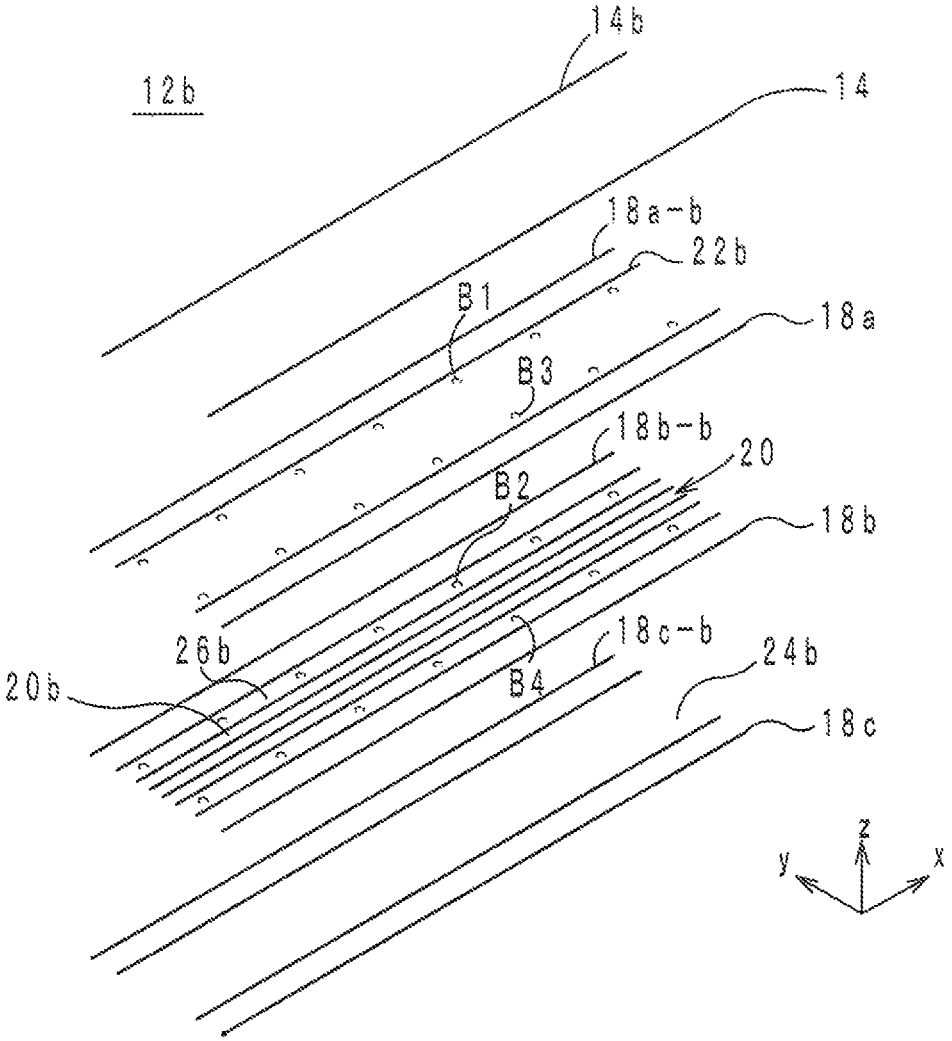
FIG. 2 is an exploded oblique view of a portion E1 of the high-frequency transmission line according to a preferred embodiment of the present invention.
Figure 3:
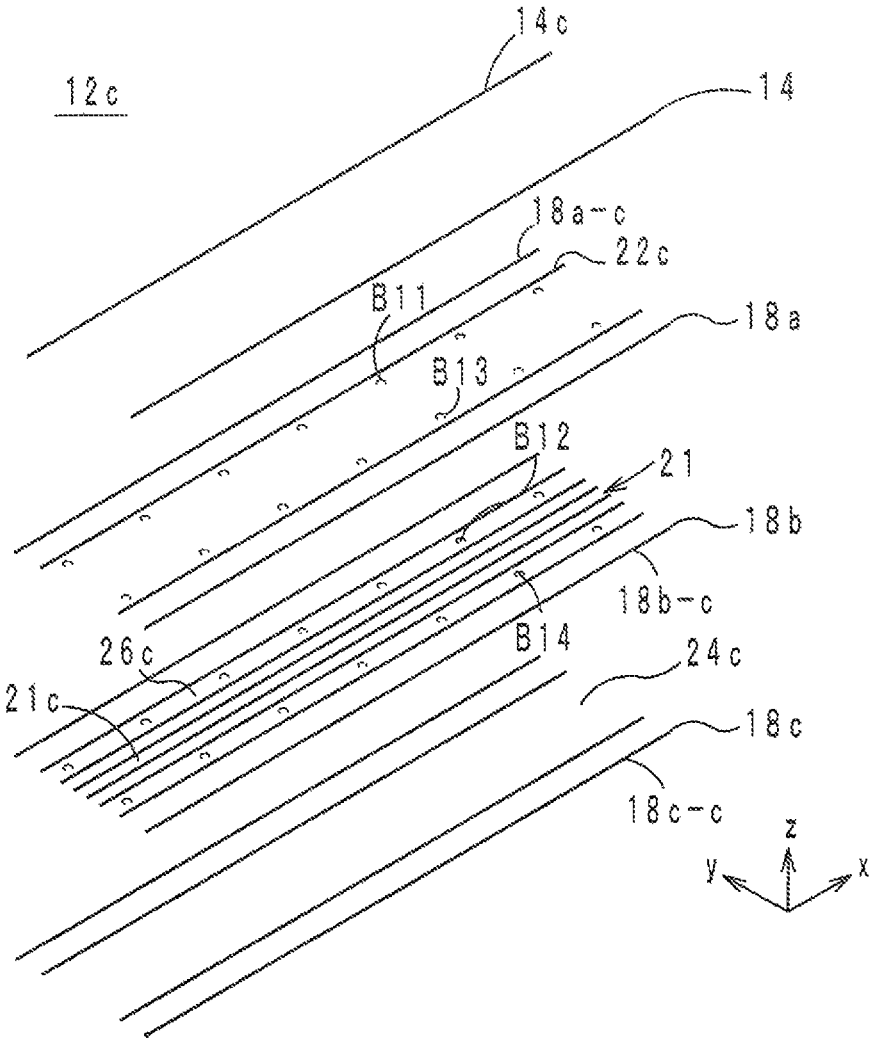
FIG. 3 is an exploded oblique view of a portion E2 of the high-frequency transmission line according to a preferred embodiment of the present invention.
Figure 4:
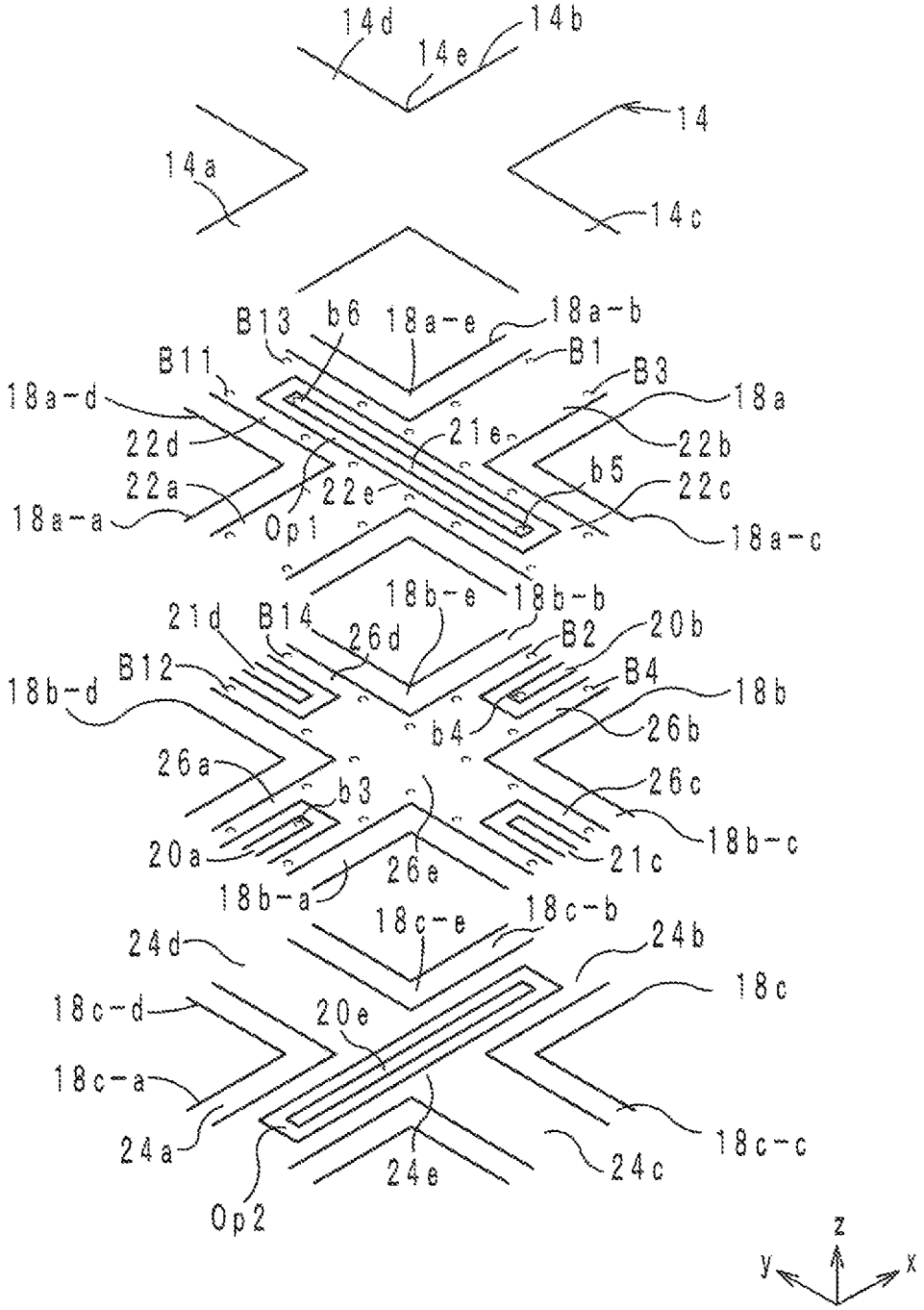
FIG. 4 is an exploded oblique view of a portion E3 of the high-frequency transmission line according to a preferred embodiment of the present invention.
Figure 5:
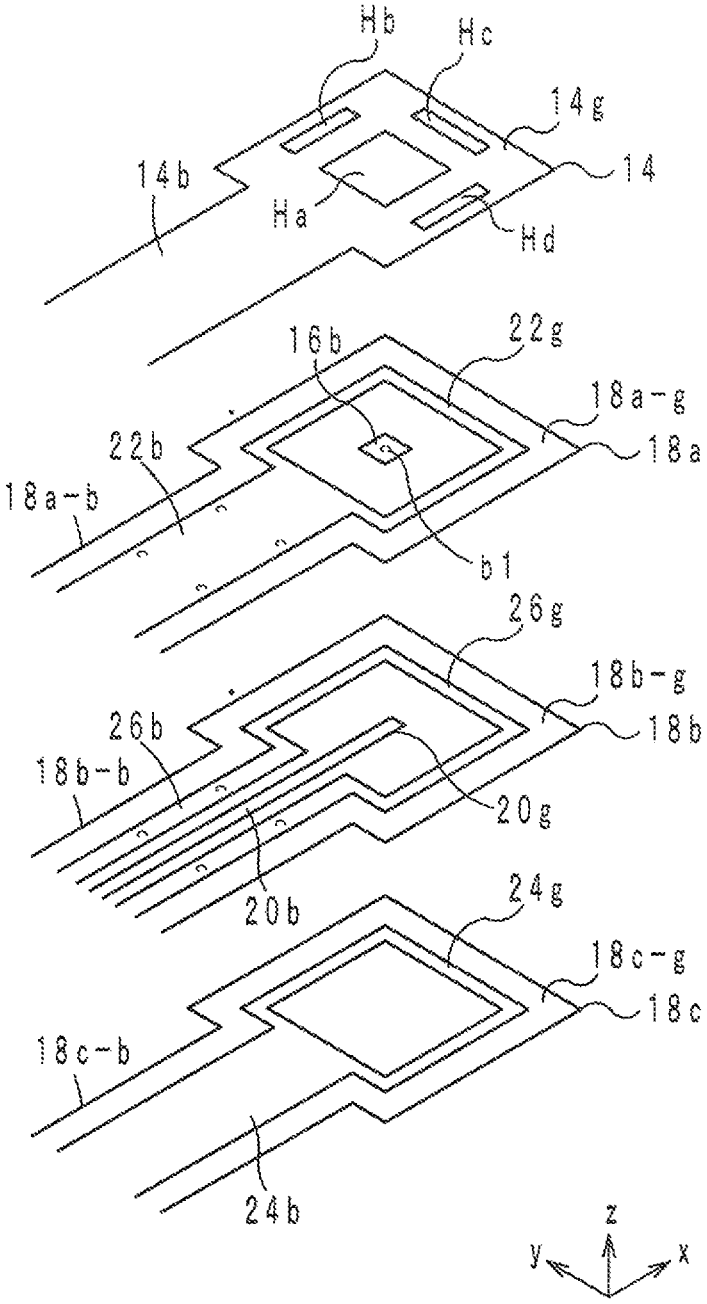
FIG. 5 is an exploded oblique view of a connecting portion of the high-frequency transmission line according to a preferred embodiment of the present invention.
Figure 6:
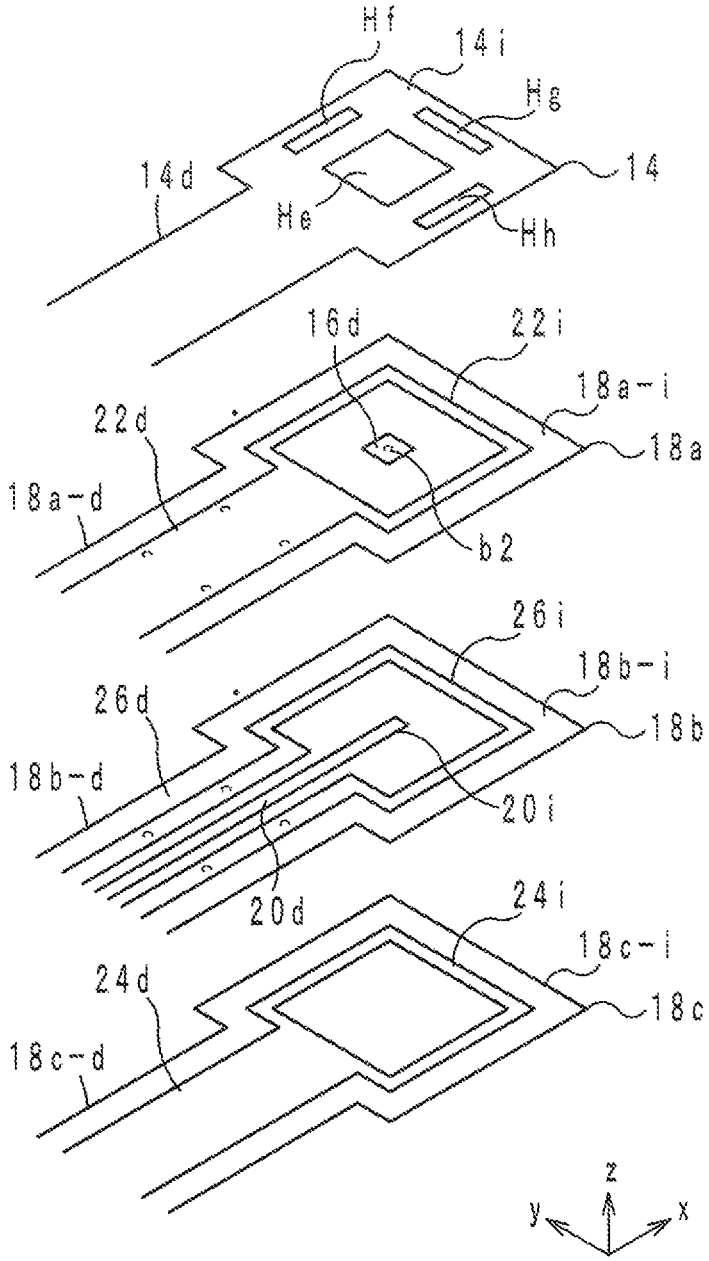
FIG. 6 is an exploded oblique view of another connecting portion of the high-frequency transmission line according to a preferred embodiment of the present invention.
Figure 7:
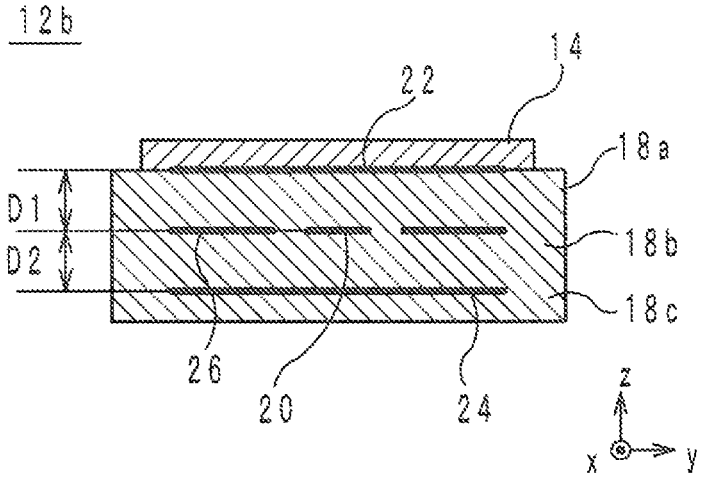
FIG. 7 is a cross-sectional structure view of the portion E1 of the high-frequency transmission line according to a preferred embodiment of the present invention.
Figure 8:
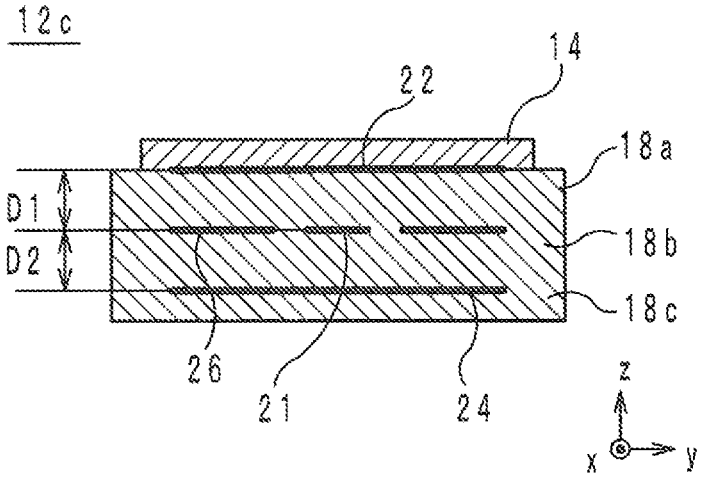
FIG. 8 is across-sectional structure view of the section E2 of the high-frequency transmission line according to a preferred embodiment of the present invention.

The configuration of the high-frequency transmission line according to a preferred embodiment of the present invention will be described below with reference to the drawings. FIG. 1 is an external oblique view of the high-frequency transmission line 10 according to the present preferred embodiment. FIG. 2 is an exploded oblique view of a portion E1 of the high-frequency transmission line 10 according to the present preferred embodiment. FIG. 3 is an exploded oblique view of a portion E2 of the high-frequency transmission line 10 according to the present preferred embodiment. FIG. 4 is an exploded oblique view of a portion E3 of the high-frequency transmission line 10 according to the present preferred embodiment. FIG. 5 is an exploded oblique view of a connecting portion 12*g* of the high-frequency transmission line 10 according to the present preferred embodiment. FIG. 6 is an exploded oblique view of a connecting portion 12*i* of the high-frequency transmission line 10 according to the present preferred embodiment. FIG. 7 is a cross-sectional structure view of the portion E1 of the high-frequency transmission line 10 according to the present preferred embodiment. FIG. 8 is a cross-sectional structure view of the section E2 of the high-frequency transmission line 10 according to the present preferred embodiment. In the following, the direction of lamination of the high-frequency transmission line 10 will be defined as a z-axis direction, for example. Moreover, the longitudinal direction of the high-frequency transmission line 10 will be defined as an x-axis direction, and the direction perpendicular to the x-axis and z-axis directions will be defined as a y-axis direction, for example.

As shown in FIGS. 1 through 6, the high-frequency transmission line 10 includes a dielectric element assembly 12, external terminals 16*a* to 16*d* (only the external terminals 16*b* and 16*d* are shown in the figures), signal lines 20 and 21, ground conductors 22, 24 and 26, connectors 100*a* to 100*d*, and via-hole conductors b1, b2, B1 to B4, and B11 to B14.

The dielectric element assembly 12 includes line portions 12*a* to 12*d*, a crossing portion 12*e*, and connecting portions 12*f* to 12*i*. The dielectric element assembly 12 is a flexible laminate preferably formed by laminating a protective layer 14 and dielectric sheets (dielectric layers) 18*a* to 18*c* in this order, from the positive side to the negative side in the z-axis direction, as shown in FIG. 2. In the following, the principal surface of the dielectric element assembly 12 that is located on the positive side in the z-axis direction will be referred to as a top surface, and the principal surface of the dielectric element assembly 12 that is located on the negative side in the z-axis direction will be referred to as a bottom surface.

The crossing portion 12*e* is positioned near the center of the dielectric element assembly 12 both in the x-axis direction and in the y-axis direction. The line portion 12*a* extends from the crossing portion 12*e* toward the negative side in the x-axis direction. The line portion 12*b* extends from the crossing portion 12*e* toward the positive side in the x-axis direction. The line portion 12*c* extends from the crossing portion 12*e* toward the negative side in the y-axis direction, and bends to the negative side in the x-axis direction. The line portion 12*d* extends from the crossing portion 12*e* toward the positive side in the y-axis direction, and bends to the positive side in the x-axis direction.

The connecting portion 12*f* preferably has a rectangular or substantially rectangular shape connected to the end of the line portion 12*a* that is located on the negative side in the x-axis direction. The connecting portion 12*g* preferably has a rectangular or substantially rectangular shape connected to the end of the line portion 12*b* that is located on the positive side in the x-axis direction. The connecting portion 12*h* preferably has a rectangular or substantially rectangular shape connected to the end of the line portion 12*c* that is located on the negative side in the x-axis direction. The connecting portion 12*i* preferably has a rectangular or substantially rectangular shape connected to the end of the line portion 12*d* that is located on the positive side in the x-axis direction.

The dielectric sheets 18*a* to 18*c*, when viewed in a plan view in the z-axis direction, preferably have the same shape as the dielectric element assembly 12. The dielectric sheets 18*a* to 18*c* are made of a flexible thermoplastic resin such as liquid crystal polymer or polyimide. The thickness D1 of the dielectric sheet 18*a* is equal or approximately equal to the thickness D2 of the dielectric sheet 18*b*, as shown in FIGS. 7 and 8. After lamination of the dielectric sheets 18*a* to 18*c*, the thicknesses D1 and D2 are, for example, about 50 μm to about 300 μm. In the present preferred embodiment, both of the thicknesses D1 and D2 preferably are about 150 μm, for example. In the following, the principal surface of each of the dielectric sheets 18*a* to 18*c* that is located on the positive side in the z-axis direction will be referred to as a top surface, and the principal surface of each of the dielectric sheets 18*a* to 18*c* that is located on the negative side in the z-axis direction will be referred to as a bottom surface.

Furthermore, the dielectric sheet 18*a* includes line portions 18*a-a*, 18*a-b*, 18*a-c*, and 18*a-d*, a crossing portion 18*a-e*, and connecting portions 18*a-f*, 18*a-g*, 18*a-h*, and 18*a-i*. The dielectric sheet 18*b* includes line portions 18*b-a*, 18*b-b*, 18*b-c*, and 18*b-d*, a crossing portion 18*b-e*, and connecting portions 18*b-f*, 18*b-g*, 18*b-h*, and 18*b-i*. The dielectric sheet 18*c* includes line portions 18*c-a*, 18*c-b*, 18*c-c*, and 18*c-d*, a crossing portion 18*c-e*, and connecting portions 18*c-f*, 18*c-g*, 18*c-h*, and 18*c-i*.

The line portion 12*a* includes line portions 18*a-a*, 18*b-a*, and 18*c-a*. The line portion 12*b* includes line portions 18*a-b*, 18*b-b*, and 18*c-b*. The line portion 12*c* includes line portions 18*a-c*, 18*b-c*, and 18*c-c*. The line portion 12*d* includes line portions 18*a-d*, 18*b-d*, and 18*c-d*. The crossing portion 12*e* includes crossing portions 18*a-e*, 18*b-e*, and 18*c-e*. The connecting portion 12*f* includes connecting portions 18*a-f*, 18*b-f*, and 18*c-f*. The connecting portion 12*g* includes connecting portions 18*a-g*, 18*b-g*, and 18*c-g*. The connecting portion 12*h* includes connecting portions 18*a-h*, 18*b-h*, and 18*c-h*. The connecting portion 12*i* includes connecting portions 18*a-i*, 18*b-i*, and 18*c-i*.

The signal line 20 (first signal line) is a linear conductor provided in the dielectric element assembly 12 and consisting of line conductors 20*a*, 20*b*, 20*e*, 20*f*, and 20*g* (the line conductor 20*f* is not shown in the figures) and via-hole conductors b3 and b4. The line conductors 20*a* and 20*b* extend in the x-axis direction along the top surfaces of the line portions 18*b-a* and 18*b-b*, respectively, as shown in FIGS. 2 and 4. The line conductor 20*e* extends in the x-axis direction along the top surface of the crossing portion 18*c-e*, as shown in FIG. 4. The line portions 20*f* and 20*g* extend in the x-axis direction along the top surfaces of the connecting portions 18*b-f* and 18*b-g*, respectively, as shown in FIG. 5 (only the line portion 20*g* is shown).

Furthermore, the via-hole conductor b3 pierces through the line portion 18*b-a* in the z-axis direction, as shown in FIG. 4, and connects the end of the line conductor 20*a* that is located on the positive side in the x-axis direction to the end of the line conductor 20*e* that is located on the negative side in the x-axis direction. The via-hole conductor b4 pierces through the line portion 18*b-b* in the z-axis direction, as shown in FIG. 4, and connects the end of the line conductor 20*b* that is located on the negative side in the x-axis direction to the end of the line conductor 20*e* that is located on the positive side in the x-axis direction.

Furthermore, the line conductor 20*f* (not shown) is connected to the end of the line conductor 20*a* that is located on the negative side in the x-axis direction. The line conductor 20*g* is connected to the end of the line conductor 20*b* that is located on the positive side in the x-axis direction, as shown in FIG. 5. Accordingly, the line conductors 20*f* and 20*g*, the via-hole conductor b3, the line conductor 20*e*, the via-hole conductor b4, and the line conductors 20*b* and 20*g* are connected in this order so as to define the signal line 20. Note that the signal line 20 is positioned approximately at the center in the width direction of the dielectric sheets 18. The signal line 20 as above preferably is made of a metal material mainly composed of silver or copper and having a low specific resistance, for example.

The signal line 21 (second signal line) is a linear conductor provided in the dielectric element assembly 12 and consisting of line conductors 21*c*, 21*d*, 21*e*, 21*h*, and 21*i* (the line conductor 21*h* is not shown in the figures) and via-hole conductors b5 and b6. The line conductor 21*c* extends along the top surface of the line portion 18*b-c*, as shown in FIG. 4, and more specifically, the line conductor 21*c* extends toward the negative side in the y-axis direction, and bends to the negative side in the x-axis direction. The line conductor 21*d* extends along the top surface of the line portion 18*b-d*, as shown in FIG. 4, and more specifically, the line conductor 21*d* extends toward the positive side in the y-axis direction, and bends to the positive side in the x-axis direction. The line conductor 21*e* extends in the y-axis direction along the top surface of the crossing portion 18*a-e*, as shown in FIG. 4. The line portions 21*h* and 21*i* extend in the x-axis direction along the top surfaces of the connecting portions 18*b-h* and 18*b-i*, respectively.

Furthermore, the via-hole conductor b5 pierces through the line portion 18*a-c* in the z-axis direction, as shown in FIG. 4, and connects the end of the line conductor 21*c* that is located on the positive side in the y-axis direction to the end of the line conductor 21*e* that is located on the negative side in the y-axis direction. The via-hole conductor b6 pierces through the line portion 18*a-d* in the z-axis direction, as shown in FIG. 4, and connects the end of the line conductor 21*d* that is located on the negative side in the y-axis direction to the end of the line conductor 21*e* that is located on the positive side in the y-axis direction.

Furthermore, the line conductor 21*h* (not shown) is connected to the end of the line conductor 21*c* that is located on the negative side in the x-axis direction. The line conductor 21*i* is connected to the end of the line conductor 21*g* that is located on the positive side in the x-axis direction, as shown in FIG. 6. Accordingly, the line conductors 21*h* and 21*c*, the via-hole conductor b5, the line conductor 21*e*, the via-hole conductor b6, and the line conductors 21*d* and 21*i* are connected in this order so as to define the signal line 21. Note that the signal line 21 is positioned approximately at the center in the width direction of the dielectric sheets 18. The signal line 21 as above preferably is made of a metal material mainly composed of silver or copper and having a low specific resistance, for example.

The signal lines 20 and 21 thus configured cross each other at the crossing portion 12*e* when viewed in a plan view in the z-axis direction. In addition, the portion of the signal line 20 that crosses the signal line 21 (i.e., the line conductor 20*e*) is positioned on the negative side in the z-axis direction relative to the portions of the signal line 20 that do not cross the signal line 21 (i.e., the line conductors 20*a* and 20*b* and the connecting conductors 20*f* and 20*g*). Similarly, the portion of the signal line 21 that crosses the signal line 20 (i.e., the line conductor 21*e*) is positioned on the positive side in the z-axis direction relative to the portions of the signal line 21 that do not cross the signal line 20 (i.e., the line conductors 21*c* and 21*d* and the connecting conductors 21*h* and 21*i*). That is, the signal lines 20 and 21 cross each other at positions farther away from each other in the z-axis direction than at positions where they do not cross each other.

The ground conductor 22 (first ground conductor) is provided in the dielectric element assembly 12, more specifically, on the top surface of the dielectric sheet 18*a*, as shown in FIGS. 2 through 6. Accordingly, the ground conductor 22 is positioned on the positive side in the z-axis direction relative to the portions where the signal lines 20 and 21 do not cross each other (i.e., the line conductors 20*a*, 20*b*, 21*c*, and 21*d* and the connecting conductors 20*f*, 20*g*, 21*h*, and 21*i*). The ground conductor 22, when viewed in a plan view in the z-axis direction, preferably has the same or approximately the same shape as the dielectric element assembly 12, and is made of a metal material mainly composed of silver or copper and having a low specific resistance, for example.

Furthermore, as shown in FIGS. 2 through 6, the ground conductor 22 includes main conductors 22*a* to 22*d*, a crossing conductor 22*e*, and terminal conductors 22*f* to 22*i* (the terminal conductors 22*f* and 22*h* are not shown in the figures).

The main conductors 22*a* to 22*d* and the crossing conductor 22*e* are positioned on the top surfaces of the line portions 18*a-a* to 18*a-d* and the crossing portion 18*a-e*, respectively, so as to overlap with the line conductors 20*a*, 20*b*, 21*c*, and 21*d* of the signal lines 20 and 21 when viewed in a plan view in the z-axis direction. The main conductors 22*c* and 22*d* and the crossing conductor 22*e* have an opening Op1 provided therein. The line conductor 21*e* is positioned within the opening Op1. Accordingly, the main conductors 22*c* and 22*d* and the crossing conductor 22*e* are not in contact with the line conductor 21*e*. Moreover, there is no opening other than the opening Op1 provided in the main conductors 22*a* to 22*d*. Accordingly, the main conductors 22*a* to 22*d* have no opening that overlaps with the signal lines 20 and 21. Note that the main conductors 22*a* to 22*d* are strip-shaped solid conductors extending along the line portions 18*a-a* to 18*a-d*, respectively, and connected at the crossing portion 18*a-e*.

The terminal conductor 22*g* is positioned on the top surface of the connecting portion 18*a-g*, and is connected to the end of the main conductor 22*b* that is located on the positive side in the x-axis direction, as shown in FIG. 5. The terminal conductor 22*g* is in the shape of a rectangular or substantially rectangular or substantially rectangular frame. The terminal conductor 22*f* is positioned on the top surface of the connecting portion 18*a-f*, and is connected to the end of the main conductor 22*a* that is located on the negative side in the x-axis direction. The terminal conductor 22*f* has the same structure as the terminal conductor 22*g*, and therefore, is not shown in the figure.

The terminal conductor 22*i* is positioned on the top surface of the connecting portion 18*a-i*, and is connected to the end of the main conductor 22*d* that is located on the positive side in the x-axis direction, as shown in FIG. 6. The terminal conductor 22*i* is in the shape of a rectangular or substantially rectangular or substantially rectangular frame. The terminal conductor 22*h* is positioned on the top surface of the connecting portion 18*a-h*, and is connected to the end of the main conductor 22*c* that is located on the negative side in the x-axis direction. The terminal conductor 22*h* has the same structure as the terminal conductor 22*i*, and therefore, is not shown in the figure.

The ground conductor 24 (second ground conductor) is provided in the dielectric element assembly 12, more specifically, on the top surface of the dielectric sheet 18*c*, as shown in FIGS. 2 through 6. Accordingly, the ground conductor 24 is positioned on the negative side in the z-axis direction relative to the portions where the signal lines 20 and 21 do not cross each other (i.e., the line conductors 20*a*, 20*b*, 21*c*, and 21*d* and the connecting conductors 20*f*, 20*g*, 21*h*, and 21*i*). The ground conductor 24, when viewed in a plan view in the z-axis direction, preferably has the same or approximately the same shape as the dielectric element assembly 12, and is made of a metal material mainly composed of silver or copper and having a low specific resistance, for example.

Furthermore, as shown in FIGS. 2 through 6, the ground conductor 24 includes main conductors 24*a* to 24*d*, a crossing conductor 24*e*, and terminal conductors 24*f* to 24*i* (the terminal conductors 24*f* and 24*h* are not shown in the figures).

The main conductors 24*a* to 24*d* and the crossing conductor 24*e* are positioned on the top surfaces of the line portions 18*c-a* to 18*c-d* and the crossing portion 18*c-e*, respectively, so as to overlap with the line conductors 20*a*, 20*b*, 21*c*, and 21*d* of the signal lines 20 and 21 when viewed in a plan view in the z-axis direction. The main conductors 24*a* and 24*b* and the crossing conductor 24*e* have an opening Op2 provided therein. The line conductor 20*e* is positioned within the opening Op2. Accordingly, the main conductors 24*a* and 24*b* and the crossing conductor 24*e* are not in contact with the line conductor 20*e*. Moreover, there is no opening other than the opening Op2 provided in the main conductors 24*a* to 24*d*. Accordingly, the main conductors 24*a* to 24*d* have no opening that overlaps with the signal lines 20 and 21. Note that the main conductors 24*a* to 24*d* are strip-shaped solid conductors extending along the line portions 18*c-a* to 18*c-d*, respectively, and connected at the crossing portion 18*c-e*.

The terminal conductor 24*g* is positioned on the top surface of the connecting portion 18*c-g*, and is connected to the end of the main conductor 24*b* that is located on the positive side in the x-axis direction, as shown in FIG. 5. The terminal conductor 24*g* is in the shape of a rectangular or substantially rectangular frame. The terminal conductor 24*f* is positioned on the top surface of the connecting portion 18*c-f*, and is connected to the end of the main conductor 24*a* that is located on the negative side in the x-axis direction. The terminal conductor 24*f* has the same structure as the terminal conductor 24*g*, and therefore, is not shown in the figure.

The terminal conductor 24*i* is positioned on the top surface of the connecting portion 18*c-i*, and is connected to the end of the main conductor 24*d* that is located on the positive side in the x-axis direction, as shown in FIG. 6. The terminal conductor 24*i* is in the shape of a rectangular or substantially rectangular frame. The terminal conductor 24*h* is positioned on the top surface of the connecting portion 18*c-h*, and is connected to the end of the main conductor 24*c* that is located on the negative side in the x-axis direction. The terminal conductor 24*h* has the same structure as the terminal conductor 24*i*, and therefore, is not shown in the figure.

In this manner, the line conductors 20*a* and 20*b* of the signal line 20 are sandwiched between the ground conductors 22 and 24 in the z-axis direction. Accordingly, the line conductors 20*a* and 20*b* and the ground conductors 22 and 24 define a tri-plate stripline structure. Similarly, the line conductors 21*c* and 21*d* of the signal line 21 are sandwiched between the ground conductors 22 and 24 in the z-axis direction. Accordingly, the line conductors 21*c* and 21*d* and the ground conductors 22 and 24 define a tri-plate stripline structure.

The ground conductor 26 (intermediate ground conductor) is provided in the dielectric element assembly 12, more specifically, on the top surface of the dielectric sheet 18*b*, as shown in FIGS. 2 through 6. The ground conductor 26, when viewed in a plan view in the z-axis direction, preferably has the same or approximately the same shape as the dielectric element assembly 12, and is made of a metal material mainly composed of silver or copper and having a low specific resistance.

Furthermore, as shown in FIGS. 2 through 6, the ground conductor 26 includes main conductors 26*a* to 26*d*, a crossing conductor 26*e*, and terminal conductors 26*f* to 26*i* (the terminal conductors 26*f* and 26*h* are not shown in the figures).

The main conductors 26*a* to 26*d* are pairs of linear conductors extending along the line portions 18*b-a* to 18*b-d*, respectively. More specifically, the main conductor 26*a* is positioned on the top surface of the line portion 18*b-a*, such that the pair of linear conductors are on opposite sides in the width direction of the line conductor 20*a* when viewed in a plan view in the z-axis direction. The main conductor 26*b* is positioned on the top surface of the line portion 18*b-b*, such that the pair of linear conductors are on opposite sides in the width direction of the line conductor 20*b* when viewed in a plan view in the z-axis direction. That is, the line conductors 20*a* and 20*b* are sandwiched by the main conductors 26*a* and 26*b*, respectively, in the width direction. Moreover, the main conductor 26*c* is positioned on the top surface of the line portion 18*b-c*, such that the pair of linear conductors are on opposite sides in the width direction of the line conductor 21*c* when viewed in a plan view in the z-axis direction. The main conductor 26*d* is positioned on the top surface of the line portion 18*b-d*, such that the pair of linear conductors are on opposite sides in the width direction of the line conductor 21*d* when viewed in a plan view in the z-axis direction. That is, the line conductors 21*c* and 21*d* are sandwiched by the main conductors 26*c* and 26*d*, respectively, in the width direction.

The crossing conductor 26*e* is positioned on the top surface of the crossing portion 18*b-e*. Accordingly, the crossing conductor 26*e* is positioned between the line conductors 20*e* and 21*e* in the z-axis direction, so as to overlap with the crossing portions of the line conductors 20*e* and 21*e* when viewed in a plan view in the z-axis direction. Moreover, the crossing conductor 26*e* is connected to the main conductors 26*a* to 26*d*.

The terminal conductor 26*g* is positioned on the top surface of the connecting portion 18*b-g*, and is connected to the end of the main conductor 26*b* that is located on the positive side in the x-axis direction, as shown in FIG. 5. The terminal conductor 26*g* is in the shape of a rectangular or substantially rectangular frame. The terminal conductor 26*f* is positioned on the top surface of the connecting portion 18*b-f*, and is connected to the end of the main conductor 26*a* that is located on the negative side in the x-axis direction. The terminal conductor 26*f* has the same structure as the terminal conductor 26*g*, and therefore, is not shown in the figure.

The terminal conductor 26*i* is positioned on the top surface of the connecting portion 18*b-i*, and is connected to the end of the main conductor 26*d* that is located on the positive side in the x-axis direction, as shown in FIG. 6. The terminal conductor 26*i* is in the shape of a rectangular or substantially rectangular frame. The terminal conductor 26*h* is positioned on the top surface of the connecting portion 18*b-h*, and is connected to the end of the main conductor 26*c* that is located on the negative side in the x-axis direction. The terminal conductor 26*h* has the same structure as the terminal conductor 26*i*, and therefore, is not shown in the figure.

Here, the distance D1 between the signal line 20 and the ground conductor 22 in the z-axis direction is equal or approximately equal to the distance D2 between the signal line 20 and the ground conductor 24 in the z-axis direction, as shown in FIG. 7. The distance D1 is equal or approximately equal to the thickness of the dielectric sheet 18*a*, and the distance D2 is equal or approximately equal to the thickness of the dielectric sheet 18*b*.

Furthermore, the distance D1 between the signal line 21 and the ground conductor 22 in the z-axis direction is equal or approximately equal to the distance D2 between the signal line 21 and the ground conductor 24 in the z-axis direction, as shown in FIG. 8. The distance D1 is equal or approximately equal to the thickness of the dielectric sheet 18*a*, and the distance D2 is equal or approximately equal to the thickness of the dielectric sheet 18*b*.

The external terminal 16*b* is a rectangular or substantially rectangular or substantially rectangular conductor provided on the top surface of the connecting portion 18*a-g* and surrounded by the terminal conductor 22*g*, as shown in FIG. 5. The external terminal 16*b*, when viewed in a plan view in the z-axis direction, overlaps with the end of the line conductor 20*g* that is located on the positive side in the x-axis direction. The external terminal 16*b* preferably is made of a metal material mainly composed of silver or copper and having a low specific resistance, for example. In addition, the top surface of the external terminal 16*b* preferably is plated with gold, for example.

The external terminal 16*a* is a rectangular or substantially rectangular or substantially rectangular conductor provided on the top surface of the connecting portion 18*a-f* and surrounded by the terminal conductor 22*f*. The external terminal 16*a*, when viewed in a plan view in the z-axis direction, overlaps with the end of the line conductor 20*f* that is located on the negative side in the x-axis direction. The external terminal 16*a* has the same structure as the external terminal 16*b*, and therefore, is not shown in the figure.

The external terminal 16*d* is a rectangular or substantially rectangular conductor provided on the top surface of the connecting portion 18*a-i* and surrounded by the terminal conductor 22*i*, as shown in FIG. 6. The external terminal 16*d*, when viewed in a plan view in the z-axis direction, overlaps with the end of the line conductor 20*i* that is located on the positive side in the x-axis direction. The external terminal 16*d* preferably is made of a metal material mainly composed of silver or copper and having a low specific resistance, for example. In addition, the top surface of the external terminal 16*d* preferably is plated with gold, for example.

The external terminal 16*c* is a rectangular or substantially rectangular conductor provided on the top surface of the connecting portion 18*a-h* and surrounded by the terminal conductor 22*h*. The external terminal 16*c*, when viewed in a plan view in the z-axis direction, overlaps with the end of the line conductor 21*h* that is located on the negative side in the x-axis direction. The external terminal 16*c* has the same structure as the external terminal 16*d*, and therefore, is not shown in the figure.

The via-hole conductor b1 pierces through the connecting portion 18*a-g* of the dielectric sheet 18*a* in the z-axis direction. The via-hole conductor b1 connects the external terminal 16*b* to the end of the signal line 20*g* that is located on the positive side in the x-axis direction.

Note that the external terminal 16*a* (not shown) and the end of the line conductor 20*f* that is located on the negative side in the x-axis direction are connected by a via-hole conductor. The via-hole conductor that connects the external terminal 16*a* (not shown) and the end of the line conductor 20*f* that is located on the negative side in the x-axis direction is similar to the via-hole conductor b1, and therefore, is not shown in the figure.

The via-hole conductor b2 pierces through the connecting portion 18*a-i* of the dielectric sheet 18*a* in the z-axis direction. The via-hole conductor b2 connects the external terminal 16*d* to the end of the line conductor 21*i* that is located on the positive side in the x-axis direction.

Note that the external terminal 16*c* (not shown) and the end of the line conductor 12*h* that is located on the negative side in the x-axis direction are connected by a via-hole conductor. The via-hole conductor that connects the external terminal 16*c* (not shown) and the end of the line conductor 21*h* that is located on the negative side in the x-axis direction is similar to the via-hole conductor b2, and therefore, is not shown in the figure.

The via-hole conductors B1 pierce through the line portions 18*a-a* and 18*a-b* of the dielectric sheet 18*a* in the z-axis direction, and, when viewed in a plan view in the z-axis direction, the via-hole conductors B1 are positioned on the positive side in the y-axis direction relative to the signal line 20, so as to be aligned in the x-axis direction. The via-hole conductors B2 pierce through the line portions 18*b-a* and 18*b-b* of the dielectric sheet 18*b* in the z-axis direction, and, when viewed in a plan view in the z-axis direction, the via-hole conductors B2 are positioned on the positive side in the y-axis direction relative to the signal line 20, so as to be aligned in the x-axis direction. The via-hole conductors B1 and B2 are connected to each other, such that each pair constitutes a single via-hole conductor. The end of the via-hole conductor B1 that is located on the positive side in the z-axis direction is connected to the ground conductor 22, and the end of the via-hole conductor B1 that is located on the negative side in the z-axis direction is connected to the ground conductor 26. Moreover, the end of the via-hole conductor B2 that is located on the positive side in the z-axis direction is connected to the ground conductor 26, and the end of the via-hole conductor B2 that is located on the negative side in the z-axis direction is connected to the ground conductor 24. As a result, the via-hole conductors B1 and B2 connect the ground conductors 22, 24, and 26.

The via-hole conductors B3 pierce through the line portions 18*a-a* and 18*a-b* of the dielectric sheet 18*a* in the z-axis direction, and, when viewed in a plan view in the z-axis direction, the via-hole conductors B3 are positioned on the negative side in the y-axis direction relative to the signal line 20, so as to be aligned in the x-axis direction. The via-hole conductors B4 pierce through the line portions 18*b-a* and 18*b-b* of the dielectric sheet 18*b* in the z-axis direction, and, when viewed in a plan view in the z-axis direction, the via-hole conductors B4 are positioned on the negative side in the y-axis direction relative to the signal line 20, so as to be aligned in the x-axis direction. The via-hole conductors B3 and B4 are connected to each other, such that each pair constitutes a single via-hole conductor. The end of the via-hole conductor B3 that is located on the positive side in the z-axis direction is connected to the ground conductor 22, and the end of the via-hole conductor B3 that is located on the negative side in the z-axis direction is connected to the ground conductor 26. Moreover, the end of the via-hole conductor B4 that is located on the positive side in the z-axis direction is connected to the ground conductor 26, and the end of the via-hole conductor B4 that is located on the negative side in the z-axis direction is connected to the ground conductor 24. As a result, the via-hole conductors B3 and B4 connect the ground conductors 22, 24, and 26.

The via-hole conductors B11 pierce through the line portions 18*a-c* and 18*a-d* of the dielectric sheet 18*a* in the z-axis direction, and, when viewed in a plan view in the z-axis direction, the via-hole conductors B11 are positioned on the positive side in the y-axis direction relative to the signal line 21, so as to be aligned in the x-axis direction. The via-hole conductors B12 pierce through the line portions 18*b-c* and 18*b-d* of the dielectric sheet 18*b* in the z-axis direction, and, when viewed in a plan view in the z-axis direction, the via-hole conductors B12 are positioned on the positive side in the y-axis direction relative to the signal line 21, so as to be aligned in the x-axis direction. The via-hole conductors B11 and B12 are connected to each other, such that each pair constitutes a single via-hole conductor. The end of the via-hole conductor B11 that is located on the positive side in the z-axis direction is connected to the ground conductor 22, and the end of the via-hole conductor B11 that is located on the negative side in the z-axis direction is connected to the ground conductor 26. Moreover, the end of the via-hole conductor B12 that is located on the positive side in the z-axis direction is connected to the ground conductor 26, and the end of the via-hole conductor B12 that is located on the negative side in the z-axis direction is connected to the ground conductor 24. As a result, the via-hole conductors B11 and B12 connect the ground conductors 22, 24, and 26. Note that in the sections where the line portions 12*c* and 12*d* extend in the y-axis direction, the via-hole conductors B11 and B12, when viewed in a plan view in the z-axis direction, are positioned on the negative side in the x-axis direction relative to the signal line 21, as shown in FIG. 4.

The via-hole conductors B13 pierce through the line portions 18*a-c* and 18*a-d* of the dielectric sheet 18*a* in the z-axis direction, and, when viewed in a plan view in the z-axis direction, the via-hole conductors B13 are positioned on the negative side in the y-axis direction relative to the signal line 21, so as to be aligned in the x-axis direction. The via-hole conductors B14 pierce through the line portions 18*b-c* and 18*b-d* of the dielectric sheet 18*b* in the z-axis direction, and, when viewed in a plan view in the z-axis direction, the via-hole conductors B14 are positioned on the negative side in the y-axis direction relative to the signal line 21, so as to be aligned in the x-axis direction. The via-hole conductors B13 and B14 are connected to each other, such that each pair constitutes a single via-hole conductor. The end of the via-hole conductor B13 that is located on the positive side in the z-axis direction is connected to the ground conductor 22, and the end of the via-hole conductor B13 that is located on the negative side in the z-axis direction is connected to the ground conductor 26. Moreover, the end of the via-hole conductor B14 that is located on the positive side in the z-axis direction is connected to the ground conductor 26, and the end of the via-hole conductor B14 that is located on the negative side in the z-axis direction is connected to the ground conductor 24. As a result, the via-hole conductors B13 and B14 connect the ground conductors 22, 24, and 26. Note that in the sections where the line portions 12*c* and 12*d* extend in the y-axis direction, the via-hole conductors B13 and B14, when viewed in a plan view in the z-axis direction, are positioned on the positive side in the x-axis direction relative to the signal line 21, as shown in FIG. 4.

The via-hole conductors b1 to b6, B1 to B4, and B11 to B14 are preferably made of a metal material mainly composed of silver or copper and having a low specific resistance, for example. Note that through-holes with conductor layers including inner circumferential surfaces formed by plating or other suitable process may be used in place of the via-hole conductors b1 to b6, B1 to B4, and B11 to B14.

The protective layer 14 covers the entire or substantially the entire top surface of the dielectric sheet 18*a*. Accordingly, the ground conductor 22 is covered by the protective layer 14. The protective layer 14 is made of, for example, a flexible resin such as a resist material.

Furthermore, as shown in FIGS. 2 through 6, the protective layer 14 includes line portions 14*a* to 14*d*, a crossing portion 14*e*, and connecting portions 14*f* to 14*i*. The line portions 14*a* to 14*d* and the crossing portion 14*e* cover the entire top surfaces of the line portions 18*a-a*, 18*a-b*, 18*a-c*, and 18*a-d* and the crossing portion 18*a-e*, respectively, thus covering the main conductors 22*a* to 22*d*.

The connecting portion 14*g* is connected to the end of the line portion 14*b* that is located on the positive side in the x-axis direction, so as to cover the top surface of the connecting portion 18*a*-*g*, as shown in FIG. 5. The connecting portion 14*g* has rectangular or substantially rectangular openings Ha to Hd provided therein. The opening Ha is a rectangular or substantially rectangular opening positioned at the center of the connecting portion 14*g*. The external terminal 16*b* is exposed to the outside from the opening Ha. The opening Hb is a rectangular or substantially rectangular opening positioned on the positive side in the y-axis direction relative to the opening Ha. The opening Hc is a rectangular or substantially rectangular opening positioned on the positive side in the x-axis direction relative to the opening Ha. The opening Hd is a rectangular or substantially rectangular opening positioned on the negative side in the y-axis direction relative to the opening Ha. The terminal conductor 22*g* is exposed to the outside from the openings Hb to Hd, so that the exposed portions serve as external terminals. Note that the connecting portion 14*f* has the same structure as the connecting portion 14*g*, and therefore is not shown in the figure, and further, any description thereof will be omitted.

The connecting portion 14*i* is connected to the end of the line portion 14*d* that is located on the positive side in the x-axis direction, so as to cover the top surface of the connecting portion 18*a*-*i*. The connecting portion 14*i* has rectangular or substantially rectangular openings He to Hh provided therein. The opening He is a rectangular opening positioned at the center of the connecting portion 14*i*. The external terminal 16*d* is exposed to the outside from the opening He. The opening Hf is a rectangular or substantially rectangular opening positioned on the positive side in the y-axis direction relative to the opening He. The opening Hg is a rectangular or substantially rectangular opening positioned on the positive side in the x-axis direction relative to the opening He. The opening Hh is a rectangular or substantially rectangular opening positioned on the negative side in the y-axis direction relative to the opening He. The terminal portion 22*i* is exposed to the outside from the openings Hf to Hh, so that the exposed portions serve as external terminals. Note that the connecting portion 14*h* has the same structure as the connecting portion 14*i*, and therefore is not shown in the figure, and further, any description thereof will be omitted.

Figure 9:
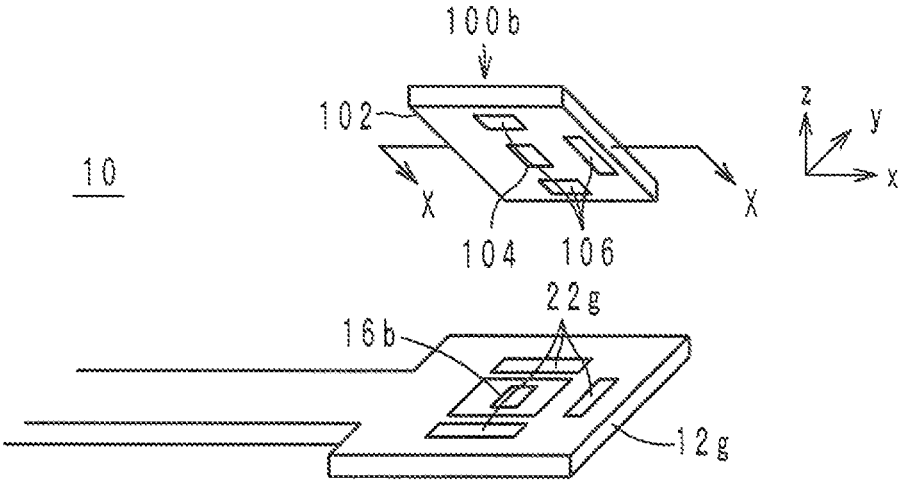
FIG. 9 is an external oblique view of a connector in the high-frequency transmission line.
Figure 10:
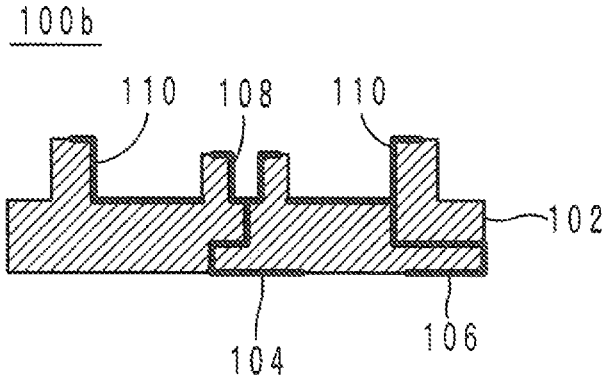
FIG. 10 is a cross-sectional structure view of the connector in the high-frequency transmission line.

The connectors 100*a* and 100*b* are mounted on the top surfaces of the connecting portions 12*f* and 12*g*, respectively, and electrically connected to the signal line 20 and the ground conductors 22, 24, and 26. The connectors 100*c* and 100*d* are mounted on the top surfaces of the connecting portions 12*h* and 12*i*, respectively, and electrically connected to the signal line 21 and the ground conductors 22, 24, and 26. The connectors 100*a* to 100*d* are configured in the same manner, and therefore, only the configuration of the connector 100*b* will be described below by way of example. FIG. 9 is an external oblique view of the connector 100*b* in the high-frequency transmission line 10. FIG. 10 is a cross-sectional structure view of the connector 100*b* in the high-frequency transmission line 10.

The connector 100*b* includes a connector body 102, external terminals 104 and 106, a center conductor 108, and an external conductor 110, as shown in FIGS. 1, 9, and 10. The connector body 102 includes a rectangular or substantially rectangular plate and a cylindrical or substantially cylindrical portion coupled thereon, and is made of an insulating material such as resin.

The external terminal 104 is positioned on the plate of the connector body 102 on the negative side in the z-axis direction, so as to face the external terminal 16*b*. The external terminal 106 is positioned on the plate of the connector body 102 on the negative side in the z-axis direction, so as to correspond to the parts of the terminal conductor 22*g* that are exposed from the openings Hb to Hd.

The center conductor 108 is positioned at the center of the cylindrical or substantially cylindrical portion of the connector body 102, and is connected to the external terminal 104. The center conductor 108 is a signal terminal to/from which a high-frequency signal is inputted/outputted. The external conductor 110 is positioned on the inner circumferential surface of the cylindrical portion of the connector body 102, and is connected to the external terminal 106. The external conductor 110 is a ground terminal to be kept at a ground potential.

The connector 100*b* thus configured is mounted on the top surface of the connecting portion 12*g*, such that the external terminal 104 is connected to the external terminal 16*b*, and the external terminal 106 is connected to the terminal conductor 22*g*, as shown in FIGS. 9 and 10. As a result, the signal line 20 is electrically connected to the center conductor 108. In addition, the ground conductors 22, 24, and 26 are electrically connected to the external conductor 110.

Figure 11:
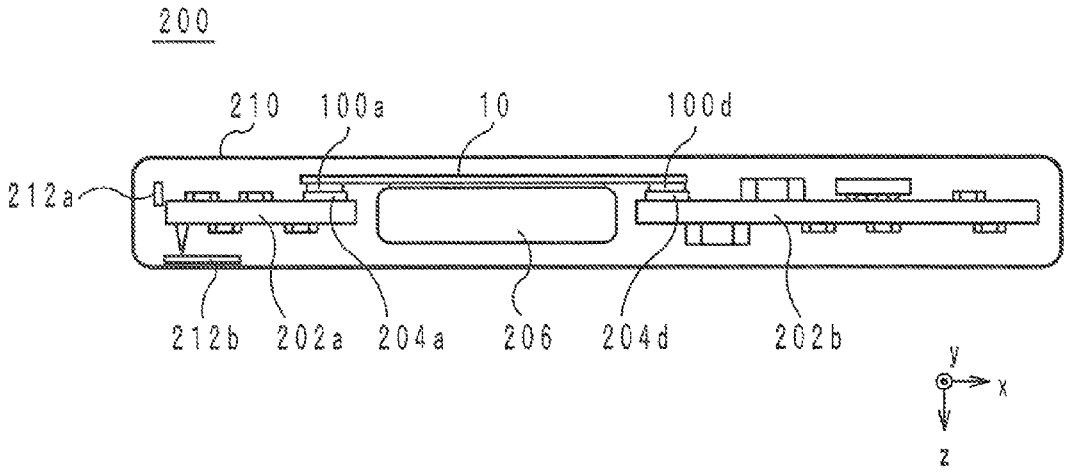
FIG. 11 illustrates an electronic device provided with the high-frequency transmission line as viewed in a plan view in the y-axis direction.
Figure 12:
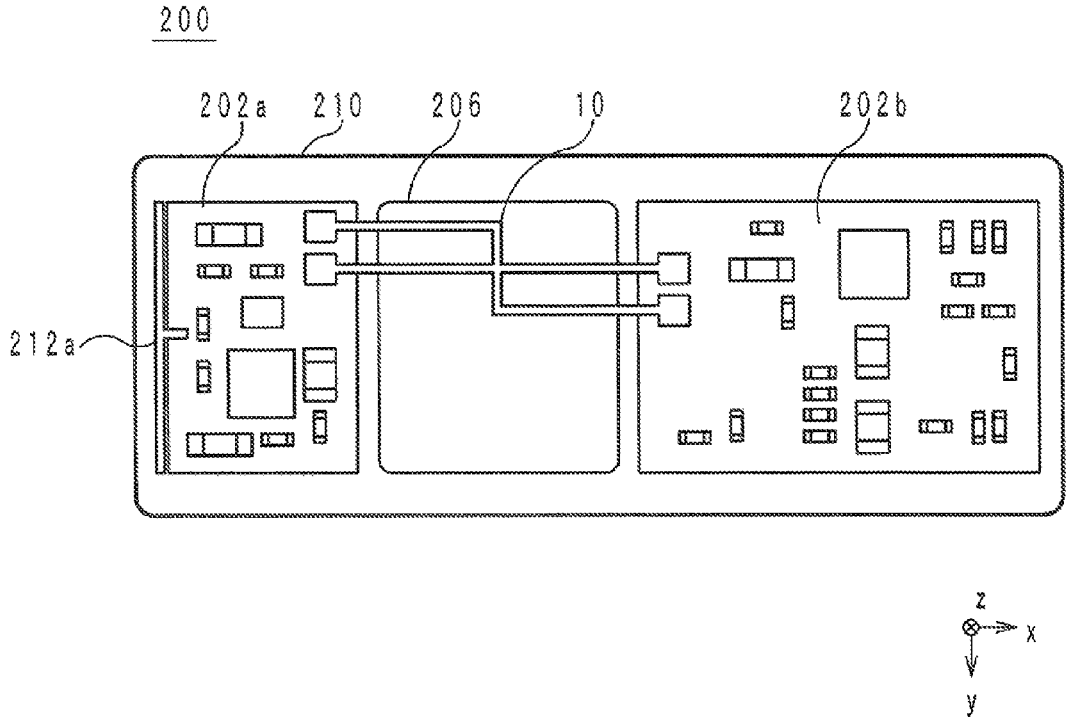
FIG. 12 illustrates the electronic device provided with the high-frequency transmission line as viewed in a plan view in the z-axis direction.

The high-frequency transmission line 10 preferably is used in a manner as will be described below. FIG. 11 illustrates an electronic device 200 provided with the high-frequency transmission line 10 as viewed in a plan view in the y-axis direction. FIG. 12 illustrates the electronic device 200 provided with the high-frequency transmission line 10 as viewed in a plan view in the z-axis direction.

The electronic device 200 includes the high-frequency transmission line 10, circuit boards 202*a* and 202*b*, receptacles 204*a* to 204*d* (the receptacles 204*b* and 204*c* are not shown in the figures), a battery pack (metallic body) 206, a housing 210, and antennas 212*a* and 212*b*.

The housing 210 accommodates the high-frequency transmission line 10, the circuit boards 202*a* and 202*b*, the receptacles 204*a* to 204*d*, the battery pack 206, and the antennas 212*a* and 212*b*, as shown in FIGS. 11 and 12. The circuit board 202*a* includes, for example, a transmission or reception circuit provided thereon. The circuit board 202*b* includes, for example, a power circuit (a radio frequency integrated circuit: RFIC) provided thereon. The battery pack 206 is, for example, a lithium-ion secondary battery, and the surface thereof is wrapped by a metal cover. The circuit board 202*a*, the battery pack 206, and the circuit board 202*b* are arranged in this order, from the negative side to the positive side in the x-axis direction.

The antenna 212*a* is connected to the circuit board 202*a* and is adapted to transmit/receive high-frequency signals in 800 MHz and 1800 MHz bands. The antenna 212*b* is connected to the circuit board 202*a* and is adapted to receive GPS signals.

The receptacle 204*a* is provided on the principal surface of the circuit board 202*a* on the negative side in the z-axis direction, and connected to the antenna 212*a* via a wiring trace provided on the circuit board 202*a*. The receptacle 204*a* is connected to the connector 100*a*. The receptacle 204*b* (not shown) is provided on the principal surface of the circuit board 202*b* on the negative side in the z-axis direction, and connected to the power circuit provided on the circuit board 202*b*. The receptacle 204*b* is connected to the connector 100*b*. Accordingly, high-frequency signals transmitted/received by the antenna 212*a* are transmitted to the signal line 20.

The receptacle 204*c* (not shown) is provided on the principal surface of the circuit board 202*a* on the negative side in the z-axis direction, and connected to the antenna 212*b* via a wiring trace provided on the circuit board 202*a*.

The receptacle 204*c* is connected to the connector 100*c*. The receptacle 204*d* is provided on the principal surface of the circuit board 202*b* on the negative side in the z-axis direction, and connected to the power circuit provided on the circuit board 202*b*. The receptacle 204*d* is connected to the connector 100*d*. Accordingly, high-frequency signals, which are GPS signals, transmitted/received by the antenna 212*b* are transmitted to the signal line 21.

Here, the top surface of the dielectric element assembly 12 (more precisely, the protective layer 14) is in contact with the battery pack 206. The dielectric element assembly 12 and the battery pack 206 are fixed by an adhesive or suchlike.

A non-limiting example of a method for producing the high-frequency transmission line 10 will be described below with reference to FIGS. 1 through 6. While the following description focuses on one high-frequency transmission line 10 as a non-limiting example, in actuality, large-sized dielectric sheets preferably are laminated and cut, so that a plurality of high-frequency transmission lines 10 are produced at the same time.

Prepared first are dielectric sheets 18*a* to 18*c* made of a thermoplastic resin and having their entire top surfaces copper-foiled. The copper-foiled surfaces of the dielectric sheets 18*a* to 18*c* are smoothened, for example, by galvanization for rust prevention. The thickness of the copper foil preferably is about 10 μm to about 20 μm, for example.

Next, external terminals 16*a* to 16*d*, a line conductor 21*e*, and a ground conductor 22 are formed on the top surface of the dielectric sheet 18*a* by photolithography. Specifically, resists are printed on the copper foil on the top surface of the dielectric sheet 18*a* in the same shapes as the external terminals 16*a* to 16*d*, the line conductor 21*e*, and the ground conductor 22. Then, any portions of the copper foil that are not coated with the resists are removed by etching the copper foil. Thereafter, the resists are removed. In this manner, the external terminals 16*a* to 16*d*, the line conductor 21*e*, and the ground conductor 22 are formed on the top surface of the dielectric sheet 18*a*.

Next, line conductors 20*a*, 20*b*, 20*f*, 20*g*, 21*c*, 21*d*, 21*h*, and 21*i* and a ground conductor 26 are formed on the top surface of the dielectric sheet 18*b* by photolithography. In addition, a line conductor 20*e* and a ground conductor 24 are formed on the top surface of the dielectric sheet 18*c* by photolithography. The line conductors 20*a*, 20*b*, 20*e*, 20*f*, 20*g*, 21*c*, 21*d*, 21*h*, and 21*i* and the ground conductors 24 and 26 are formed in the same manner as the external terminals 16*a* to 16*d*, the line conductor 21*e*, and the ground conductor 22, and therefore, any descriptions about their formation steps will be omitted.

Next, via-holes are bored through the dielectric sheets 18*a* and 18*b* by irradiating their bottom surfaces with laser beams where via-hole conductors b1 to b6, B1 to B4, and B11 to B14 are to be formed. Thereafter, the via-holes provided in the dielectric sheets 18*a* and 18*b* are filled with a conductive paste.

Next, the dielectric sheets 18*a* to 18*c* are stacked in this order, from the positive side to the negative side in the z-axis direction. Then, the dielectric sheets 18*a* to 18*c* are heated and pressed from both the positive and negative sides in the z-axis direction, thus softening the dielectric sheets 18*a* to 18*c* so as to be bonded and integrated, while solidifying the conductive paste in the via-holes, so that the via-hole conductors b1 to b6, B1 to B4, and B11 to B14 are formed. Note that the via-hole conductors b1 to b6, B1 to B4, and B11 to B14 do not have to be obtained by filling via-holes completely with conductors, and may be obtained, for example, by forming conductors only along the inner circumferential surfaces of via-holes.

Next, a resin (resist) paste is applied to the top surface of the dielectric sheet 18*a*, thereby forming a protective layer 14.

Lastly, connectors 100*a* to 100*d* are mounted on connecting portions 12*f* to 12*i*, respectively, by soldering. By the foregoing process, a high-frequency transmission line 10 is completed.

The high-frequency transmission line 10 thus configured renders it possible to reduce the thickness of the dielectric element assembly 12 at crossing portions of the signal lines 20 and 21. More specifically, in the high-frequency transmission line 10, the portions of the signal line 20 that do not cross the signal line 21 (i.e., the line conductors 20*a*, 20*b*, 20*f*, and 20*g*) and the portions of the signal line 21 that do not cross the signal line 20 (i.e., the line conductors 21*c*, 21*d*, 21*h*, and 21*i*) are positioned on the same dielectric sheet 18*b*. Moreover, the portion of the signal line 20 that crosses the signal line 21 (i.e., the line conductor 20*e*) and the portion of the signal line 21 that crosses the signal line 20 (i.e., the line conductor 21*e*) are positioned on the dielectric sheets 18*a* and 18*c*, respectively. That is, in the high-frequency transmission line 10, only the portions of the signal lines 20 and 21 that cross each other are positioned on different dielectric sheets. This renders it possible to cross the signal lines 20 and 21 within one dielectric element assembly 12. Thus, it is possible to eliminate the need to place two dielectric element assemblies on each other, so that the dielectric element assembly 12 is significantly reduced in thickness at the crossing portions of the signal lines 20 and 21.

Furthermore, the high-frequency transmission line 10 renders it possible to significantly reduce or prevent crosstalk between the signal lines 20 and 21. More specifically, the high-frequency transmission line 10 includes the ground conductor 26 provided between the signal lines 20 and 21 in the z-axis direction so as to overlap with the crossing portions of the signal lines 20 and 21. The ground conductor 26 is kept at a ground potential. Accordingly, noise emitted from both of the signal lines 20 and 21 is absorbed into the ground conductor 26. As a result, crosstalk between the signal lines 20 and 21 is significantly reduced or prevented.

Furthermore, in the high-frequency transmission line 10, the line conductors 20*a*, 20*b*, 20*f*, 20*g*, 21*c*, and 21*d* are positioned on the same dielectric sheet 18*b*. In addition, in the high-frequency transmission line 10, the characteristic impedances of the line conductors 20*a*, 20*b*, 20*f*, 20*g*, 21*c*, and 21*d* are preferably set at a predetermined value (e.g., about 50Ω) because of the ground conductors 22, 24, and 26. On the other hand, the characteristic impedance of the line conductor 20*e* is preferably set at the predetermined value (e.g., about 50Ω) because of the ground conductors 22*e* and 26*e*, and the characteristic impedance of the line conductor 21*e* is preferably set at the predetermined value (e.g., about 50Ω) because of the ground conductors 24*e* and 26*e*. As a result, the characteristic impedance among all of the line conductors is preferably set at the predetermined value (e.g., about 50Ω). Here, the line conductors 20*e* and 21*e* do not overlap with the ground conductors 22 and 24 in the z-axis direction. Accordingly, it is conceivable that the line conductors 20*e* and 21*e* might be coupled to metallic bodies, such as the battery pack 206, or grounds of external circuits. However, most of the electric-field energy (lines of electric force) of the line conductor 20*e* is coupled to the ground conductors 22*e* and 26*e*. Moreover, most of the electric-field energy (lines of electric force) of the line conductor 21*e* is coupled to the ground conductors 24*e* and 26*e*. Accordingly, the characteristic impedance does not change significantly even if the battery pack 206 and the signal line 20*e* are placed closer to each other. Thus, transmission loss is significantly reduced or prevented even if some portions of the high-frequency transmission line 10 are not covered by ground conductors.

First Modification

Figure 13:
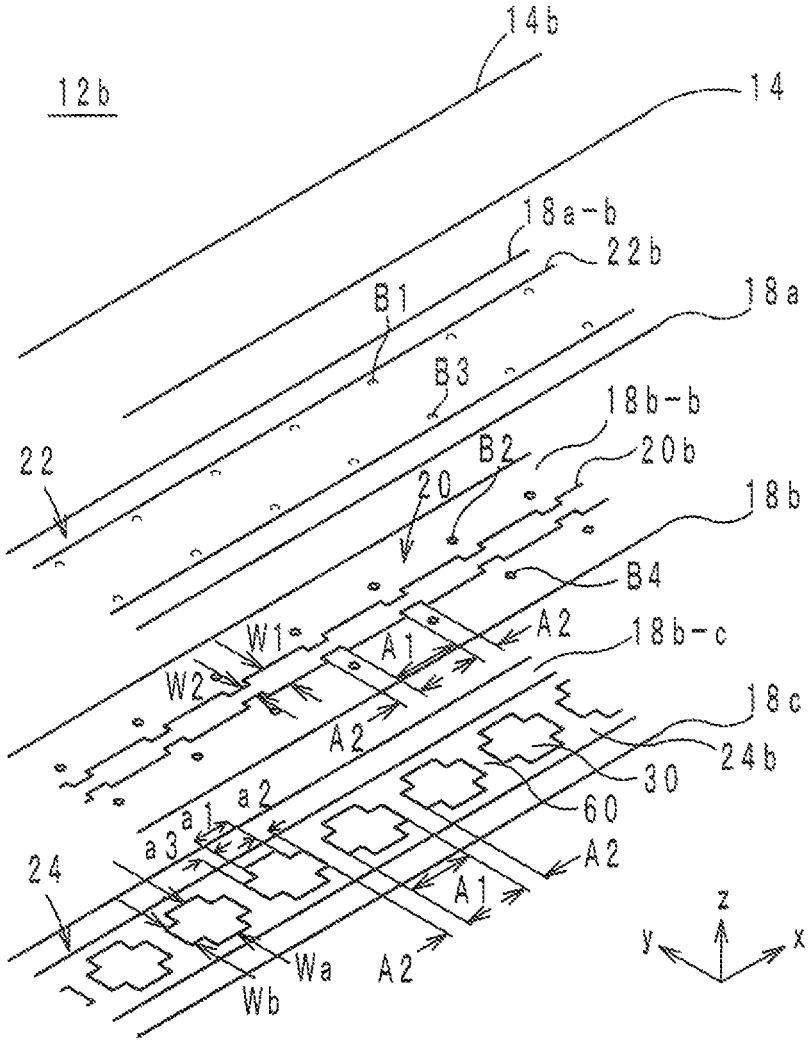
FIG. 13 is an exploded oblique view of a portion E1 of a high-frequency transmission line according to a first modification of a preferred embodiment of the present invention.
Figure 14:
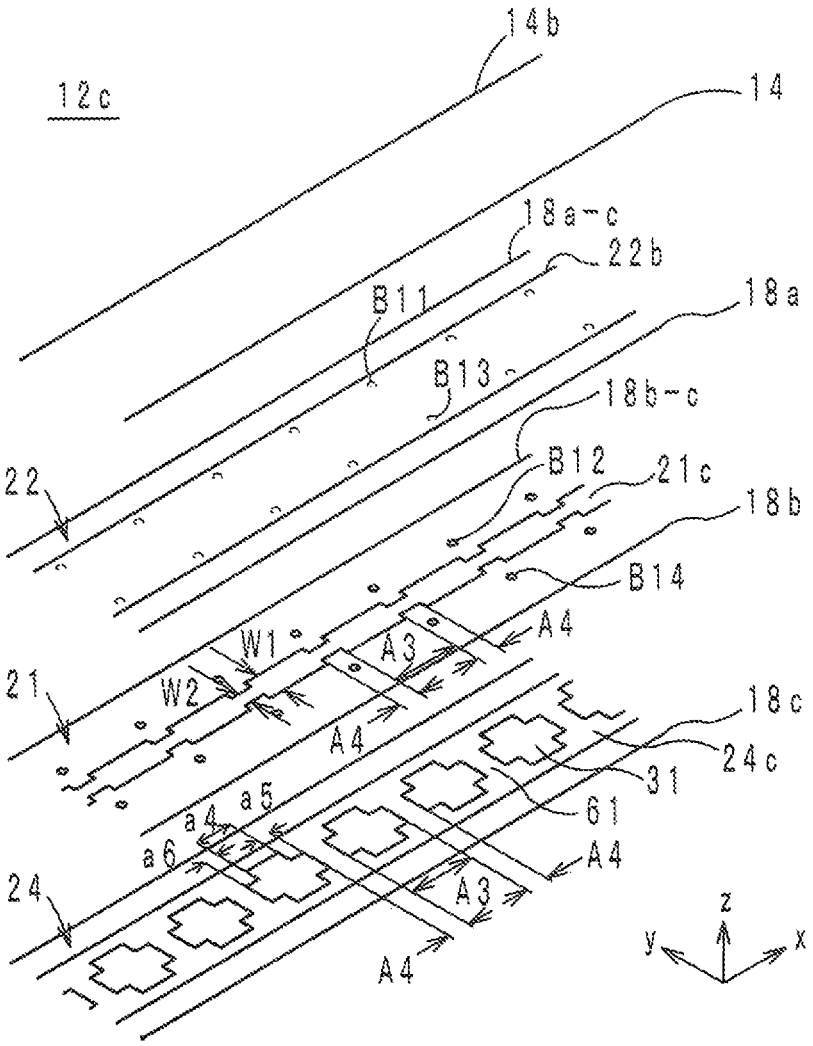
FIG. 14 is an exploded oblique view of a portion E2 of the high-frequency transmission line according to the first modification of a preferred embodiment of the present invention.
Figure 15:
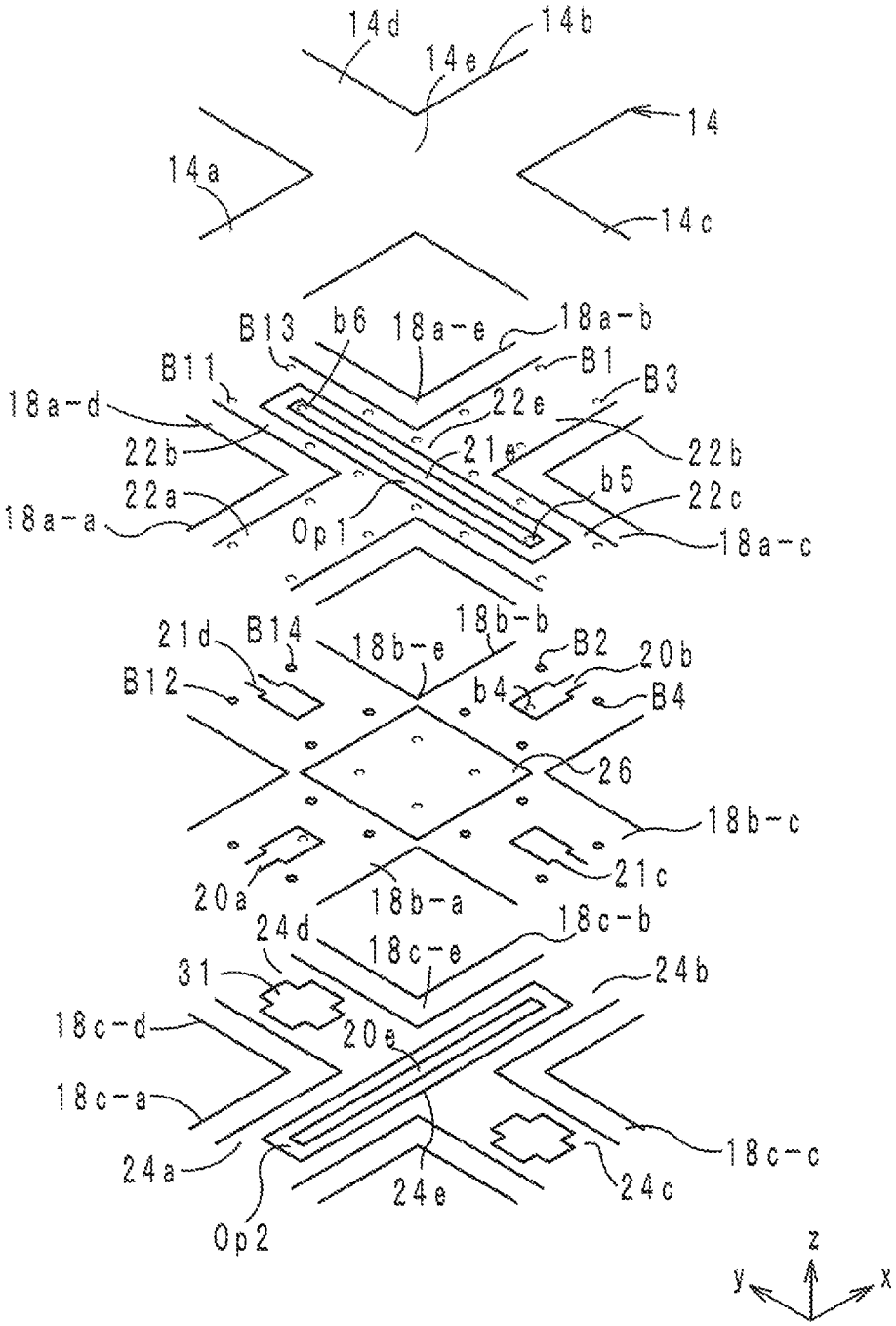
FIG. 15 is an exploded oblique view of a portion E3 of the high-frequency transmission line according to the first modification of a preferred embodiment of the present invention.
Figure 16:
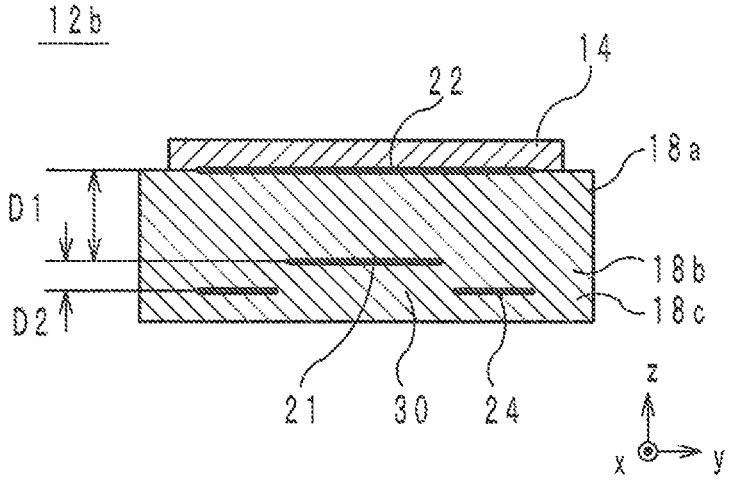
FIG. 16 is a cross-sectional structure view of a section A1 of the high-frequency transmission line according to the first modification of a preferred embodiment of the present invention.
Figure 17:
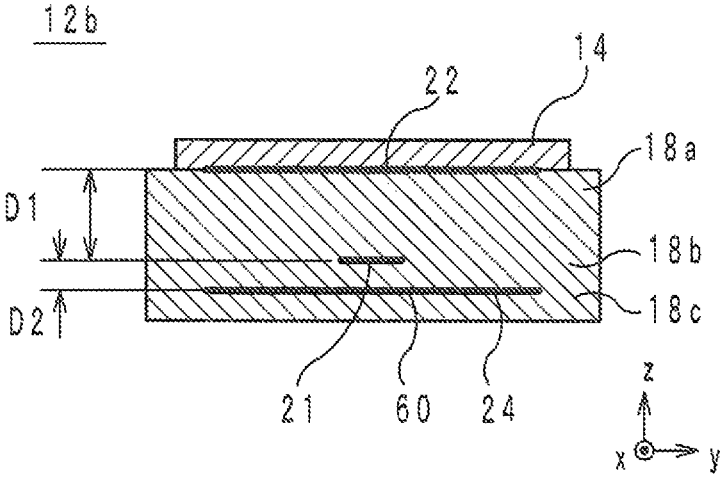
FIG. 17 is a cross-sectional structure view of a section A2 of the high-frequency transmission line according to the first modification of a preferred embodiment of the present invention.
Figure 18:
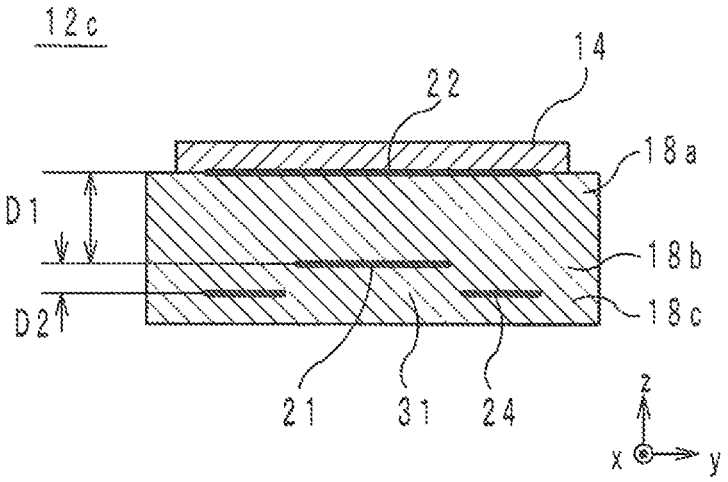
FIG. 18 is a cross-sectional structure view of a section A3 of the high-frequency transmission line according to the first modification of a preferred embodiment of the present invention.
Figure 19:
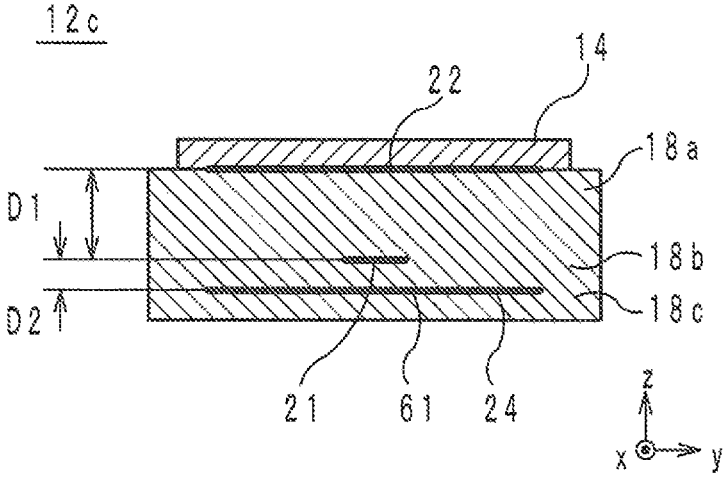
FIG. 19 is a cross-sectional structure view of a section A4 of the high-frequency transmission line according to the first modification of a preferred embodiment of the present invention.

Hereinafter, a high-frequency transmission line 10*a* according to a first modification of a preferred embodiment of the present invention will be described with reference to the drawings. FIG. 13 is an exploded oblique view of a portion E1 of the high-frequency transmission line 10*a* according to the first modification. FIG. 14 is an exploded oblique view of a portion E2 of the high-frequency transmission line 10*a* according to the first modification. FIG. 15 is an exploded oblique view of a portion E3 of the high-frequency transmission line 10*a* according to the first modification. FIG. 16 is a cross-sectional structure view of a section A1 of the high-frequency transmission line 10*a* according to the first modification. FIG. 17 is a cross-sectional structure view of a section A2 of the high-frequency transmission line 10*a* according to the first modification. FIG. 18 is a cross-sectional structure view of a section A3 of the high-frequency transmission line 10*a* according to the first modification. FIG. 19 is a cross-sectional structure view of a section A4 of the high-frequency transmission line 10*a* according to the first modification. For an external oblique view of the high-frequency transmission line 10*a*, FIG. 1 will be referenced.

The high-frequency transmission line 10*a* differs from the high-frequency transmission line 10 in that openings 30 and 31 are provided in the ground conductor 24, the signal lines 20 and 21 do not have uniform widths, and the ground conductor 26 is provided only in the crossing portion 18*b-e*. The other features of the high-frequency transmission line 10*a* are the same as the high-frequency transmission line 10, and therefore, any descriptions thereof will be omitted.

The main conductors 24*a* and 24*b* of the ground conductor 24 include a plurality of openings 30 arranged along the signal line 20, as shown in FIGS. 13 and 15. The opening 30 is shaped such that the dimension in the y-axis direction is greater at the center in the x-axis direction than at either end in the x-axis direction, as shown in FIG. 13. In the following, a section of the opening 30 that is located at the center in the x-axis direction will be referred to as a "section a1", a section located on the positive side in the x-axis direction relative to the section a1 will be referred to as a "section a2", and a section located on the negative side in the x-axis direction relative to the section a1 will be referred to as a "section a3". The dimension of the opening 30 in the y-axis direction is greater in the section a1 than both in the section a2 and in the section a3. Accordingly, the opening 30 is cross-shaped, in the shape of a rectangle whose four corners have been cut away in the shape of smaller rectangles.

The openings 30, when viewed in a plan view in the z-axis direction, overlap with the signal line 20. Portions of the ground conductor 24 that are positioned between adjacent openings 30 will be referred to as "bridge portions 60". In this manner, the openings 30 and the bridge portions 60 are arranged so as to alternate with each other along the signal line 20. Accordingly, the signal line 20 overlaps alternatingly with the openings 30 and the bridge portions 60. The interval between adjacent bridge portions 60 is shorter than half the wavelength of a high-frequency signal to be transmitted through the signal line 20.

Furthermore, in the high-frequency transmission line 10*a*, a section where the signal line 20 overlaps with the opening 30 will be referred to as a "section A1", and a section where the signal line 20 overlaps with the bridge portion 60 will be referred to as a "section A2". The width W1 of the signal line 20 in the section A1 is greater than the width W2 of the signal line 20 in the section A2, as shown in FIG. 13. More specifically, the width W1 of the signal line 20 at the overlap with the opening 30 is greater than the width W2 of the signal line 20 at the overlap with the bridge portion 60.

As described above, no openings are provided in the main conductors 22*a* and 22*b*, and the openings 30 are provided in the main conductors 24*a* and 24*b*, so that the overlap of the ground conductor 24 with the signal line 20 is smaller in area than the overlap of the ground conductor 22 with the signal line 20.

Furthermore, the main conductors 24*c* and 24*d* of the ground conductor 24 include a plurality of openings 31 arranged along the signal line 21, as shown in FIGS. 14 and 15. The opening 31 is shaped such that the dimension in the y-axis direction is greater at the center in the x-axis direction than at either end in the x-axis direction, as shown in FIG. 14. In the following, a section of the opening 31 that is located at the center in the x-axis direction will be referred to as a "section a4", a section located on the positive side in the x-axis direction relative to the section a4 will be referred to as a "section a5", and a section located on the negative side in the x-axis direction relative to the section a4 will be referred to as a "section a6". The dimension of the opening 31 in the y-axis direction is greater in the section a4 than both in the section a5 and in the section a6. Accordingly, the opening 31 is cross-shaped, in the shape of a rectangle whose four corners have been cut away in the shape of smaller rectangles.

The openings 31, when viewed in a plan view in the z-axis direction, overlap with the signal line 21. Portions of the ground conductor 24 that are positioned between adjacent openings 31 will be referred to as "bridge portions 61". In this manner, the openings 31 and the bridge portions 61 are arranged so as to alternate with each other along the signal line 21. Accordingly, the signal line 21 overlaps alternatingly with the openings 31 and the bridge portions 61. The interval between adjacent bridge portions 61 is shorter than half the wavelength of a high-frequency signal to be transmitted through the signal line 21.

Furthermore, in the high-frequency transmission line 10*a*, a section where the signal line 21 overlaps with the opening 31 will be referred to as a "section A3", and a section where the signal line 21 overlaps with the bridge portion 61 will be referred to as a "section A4". The width W1 of the signal line 21 in the section A3 is greater than the width W2 of the signal line 21 in the section A4, as shown in FIG. 14. More specifically, the width W1 of the signal line 21 at the overlap with the opening 31 is greater than the width W2 of the signal line 21 at the overlap with the bridge portion 61.

As described above, no openings are provided in the main conductors 22*c* and 22*d*, and the openings 31 are provided in the main conductors 24*c* and 24*d*, so that the overlap of the ground conductor 24 with the signal line 21 is smaller in area than the overlap of the ground conductor 22 with the signal line 21.

In this manner, the characteristic impedances of the signal lines 20 and 21 in the high-frequency transmission line 10*a* are mainly determined by the opposed areas of the signal lines 20 and 21 and the ground conductor 22 and the distances therebetween, as well as by the relative permittivities of the dielectric sheets 18*a* to 18*c*. Therefore, in the case where the characteristic impedance of each of the signal lines 20 and 21 is preferably set to about 50Ω, for example, the characteristic impedance of each of the signal lines 20 and 21 preferably is designed to become about 55Ω, slightly higher than about 50Ω, for example, because of the influence of the signal lines 20 and 21 and the ground conductor 22. Moreover, the ground conductor 24 is shaped such that the characteristic impedance of each of the signal lines 20 and 21 becomes about 50Ω because of the influence of the signal lines 20 and 21 and the ground conductors 22 and 24. In this manner, the ground conductor 22 plays the role of a reference ground conductor for the signal lines 20 and 21.

On the other hand, the ground conductor 24 is a ground conductor that doubles as a shield for the signal lines 20 and 21. Moreover, the ground conductor 24 is designed to make final adjustments such that the characteristic impedance of each of the signal lines 20 and 21 is preferably set to about 50Ω, as described above. More specifically, the sizes of the openings 30 and 31, the widths of the bridge portions 60 and 61, etc., are designed. In this manner, the ground conductor 24 plays the role of an auxiliary ground conductor for the signal lines 20 and 21.

Furthermore, the distance D1 between each of the signal lines 20 and 21 and the ground conductor 22 in the z-axis direction is greater than the distance D2 between each of the signal lines 20 and 21 and the ground conductor 24 in the z-axis direction, as shown in FIGS. 16 through 19. The distance D1 is equal or approximately equal to the thickness of the dielectric sheet 18*a*, and the distance D2 is equal or approximately equal to the thickness of the dielectric sheet 18*b*.

In the high-frequency transmission line 10*a* thus configured, the characteristic impedance of the signal line 20 repeatedly fluctuates between two adjacent bridge portions 60 in such a manner as to increase in the order: minimum value Z3, intermediate value Z2, and maximum value Z1 and thereafter, decrease in the order: maximum value Z1, intermediate value Z2, and minimum value Z3. More specifically, large capacitance is created between the signal line 20 and the ground conductor 24 in the section A2 where the signal line 20 overlaps with the bridge portion 60. Accordingly, in the section A2, capacitance (C) property is dominant in the characteristic impedance of the signal line 20. Therefore, in the section A2, the characteristic impedance of the signal line 20 is at the minimum value Z3.

Furthermore, in the signal line 20, the dimension of the opening 30 in the y-axis direction is at the maximum value in the section a1. As a result, small capacitance is created between the signal line 20 and the ground conductor 24 in the section a1. Accordingly, in the section a1, inductance (L) property is dominant in the characteristic impedance of the signal line 20. Therefore, in the section a1, the characteristic impedance of the signal line 20 is at the maximum value Z1.

Furthermore, in the signal line 20, the dimension of the opening 30 in the y-axis direction is less than the maximum value both in the section a2 and in the section a3. As a result, in the sections a2 and a3, medium capacitance is created between the signal line 20 and the ground conductor 24. Accordingly, in the sections a2 and a3, both inductance (L) and capacitance (C) properties are dominant in the characteristic impedance of the signal line 20. Therefore, in the sections a2 and a3, the characteristic impedance of the signal line 20 is at the intermediate value Z2.

Here, the sections between adjacent bridge portions 60 are arranged in the order: A2, a3, a1, a2, and A2, from the negative side to the positive side in the x-axis direction. Accordingly, the characteristic impedance of the signal line 20 fluctuates between adjacent bridge portions 60 in the order: minimum value Z3, intermediate value Z2, maximum value Z1, intermediate value Z2, and minimum value Z3. Moreover, the bridge portions 60 and the openings 30 alternatingly overlap along the signal line 20. Therefore, the characteristic impedance of the signal line 20 increases and decreases cyclically. Note that the maximum value Z1 preferably is, for example, about 70Ω, the intermediate value Z2 preferably is, for example, about 55Ω, and the minimum value Z3 preferably is, for example, about 30Ω. Further, the high-frequency transmission line 10*a* preferably is designed such that the average characteristic impedance of the entire signal line 20 is about 50Ω, for example. Note that the characteristic impedance of the signal line 21 fluctuates in the same manner as the characteristic impedance of the signal line 20.

As with the high-frequency transmission line 10, the high-frequency transmission line 10*a* thus configured is significantly reduced in thickness of the dielectric element assembly 12 at the crossing portions of the signal lines 20 and 21.

Further, as with the high-frequency transmission line 10, the high-frequency transmission line 10*a* renders it possible to significantly reduce or prevent crosstalk between the signal lines 20 and 21.

Furthermore, the high-frequency transmission line 10*a* is significantly thinner. More specifically, in the high-frequency transmission line 10*a*, the signal line 20, when viewed in a plan view in the z-axis direction, does not overlap with the ground conductor 24 in the section A1. Accordingly, little capacitance is created between the signal line 20 and the ground conductor 24. Therefore, even if the distance between the signal line 20 and the ground conductor 24 in the z-axis direction is reduced, the capacitance created between the signal line 20 and the ground conductor 24 does not become excessively large. As a result, the characteristic impedance of the signal line 20 becomes less likely to deviate from a predetermined value (e.g., about 50Ω). Thus, it is possible to make the high-frequency transmission line 10*a* thinner while keeping the characteristic impedance of the signal line 20 at the predetermined value. Note that for the same reason, it is possible to make the high-frequency transmission line 10*a* thinner while keeping the characteristic impedance of the signal line 21 at the predetermined value. Reducing the thickness of the high-frequency transmission line 10*a* allows the high-frequency transmission line 10*a* to be bent more readily.

Furthermore, in the high-frequency transmission line 10*a*, transmission loss in the signal line 20 is significantly reduced or prevented. More specifically, in the section A1, the signal line 20 overlaps with the opening 30, so that little capacitance is created between the signal line 20 and the ground conductor 24. Therefore, even if the width W1 of the signal line 20 in the section A1 is set greater than the width W2 of the signal line 20 in the section A2, the characteristic impedance of the signal line 20 does not become excessively lower in the section A1 than in the section A2. As a result, the high-frequency transmission line 10*a* renders it possible to reduce the resistance of the signal line 20 while keeping the characteristic impedance of the signal line 20 at a predetermined value. Thus, the high-frequency transmission line 10*a* renders it possible to reduce transmission loss in the signal line 20. Note that for the same reason, transmission loss in the signal line 21 is significantly reduced or prevented as well.

Furthermore, the high-frequency transmission line 10*a* renders it possible to significantly reduce or prevent the adverse effect of spurious radiation from the signal line 20. More specifically, in the high-frequency transmission line 10*a*, the openings 30 are arranged along the signal line 20. Accordingly, the characteristic impedance of the signal line 20 is higher in the section A1 where the signal line 20 overlaps with the opening 30 than in the section A2 where the signal line 20 overlaps with the bridge portion 60. Since the openings 30 and the bridge portions 60 alternatingly overlap with the signal line 20, the characteristic impedance of the signal line 20 fluctuates cyclically. In such a case, a standing wave occurs between two adjacent sections A1, resulting in spurious radiation. Therefore, by setting the interval between adjacent openings 30 less than or equal to half the wavelength of a high-frequency signal to be used by the electronic device 200, it is rendered possible to keep the frequency of spurious radiation from the signal line 20 outside the frequency band for high-frequency signals to be used by the electronic device 200. Thus, the adverse effect of spurious radiation from the signal line 20 on the electronic device 200 is significantly reduced or prevented. Note that for the same reason, the adverse effect of spurious radiation from the signal line 21 on the electronic device 200 is significantly reduced or prevented as well.

Furthermore, in the high-frequency transmission line 10*a*, the dimension of the opening 30 in the y-axis direction is greater in the section a1 than both in the section a2 and in the section a3. Accordingly, the distance between the signal line 20 and the ground conductor 24 is greater in the section a1 than in the sections a2 and a3. Moreover, the signal line 20 and the bridge portion 60 overlap with each other in the section A2. Accordingly, the distance between the signal line 20 and the ground conductor 24 is greater in the sections a2 and a3 than in the section A2. Therefore, in the section between adjacent bridge portions 60, the distance between the signal line 20 and the ground conductor 24 increases gradually, and thereafter, decreases gradually, through the course from the negative side to the positive side in the x-axis direction.

Here, a magnetic field becomes more likely to be generated around the signal line 20 as the distance between the signal line 20 and the ground conductor 24 increases. Accordingly, in the section between adjacent bridge portions 60, the magnetic field generated by the signal line 20 increases gradually, and thereafter, decreases gradually, through the course from the negative side to the positive side in the x-axis direction. As a result, the intensity of the magnetic field is prevented from changing sharply at the boundaries of the sections a1 to a3 and A2. Therefore, reflection of a high-frequency signal at the boundaries of the sections a1 to a3 and A2 is significantly reduced, so that occurrence of a standing wave in the signal line 20 is prevented. Thus, in the high-frequency transmission line 10*a*, spurious radiation from the signal line 20 is significantly reduced or prevented. Note that for the same reason, spurious radiation from the signal line 21 is significantly reduced or prevented as well.

Furthermore, in the high-frequency transmission line 10*a*, the openings 30 are provided in the ground conductor 24, so that the characteristic impedance of the signal line 20 fluctuates cyclically. Therefore, when the high-frequency transmission line 10*a* is bent, the characteristic impedance of the signal line changes to a smaller degree compared to a high-frequency transmission line in which the characteristic impedance of a signal line is constant. Here, the high-frequency transmission line in which the characteristic impedance of a signal line is constant is intended to mean a high-frequency transmission line including, for example, either a solid ground conductor or aground conductor with a slit-shaped opening.

Furthermore, in the high-frequency transmission line 10*a*, the openings 31 are provided in the ground conductor 22, so that the characteristic impedance of the signal line 21 fluctuates cyclically. Therefore, when the high-frequency transmission line 10*a* is bent, the characteristic impedance of the signal line changes to a smaller degree compared to a high-frequency transmission line in which the characteristic impedance of a signal line is constant.

Furthermore, the high-frequency transmission line 10*a* renders it possible to prevent the characteristic impedance of each of the signal lines 20 and 21 from changing from a predetermined value. More specifically, the top surface of the dielectric element assembly 12 (more precisely, the protective layer 14) is in contact with the battery pack 206. In addition, the dielectric element assembly 12 and the battery pack 206 are fixed by an adhesive or other suitable material. Therefore, the ground conductor 22 in a solid form free of openings is positioned between the signal lines 20 and 21 and the battery pack 206. As a result, capacitance is prevented from being created between each of the signal lines 20 and 21 and the battery pack 206. Thus, the characteristic impedance of each of the signal lines 20 and 21 is prevented from changing from the predetermined value.

Second Modification

Figure 20:
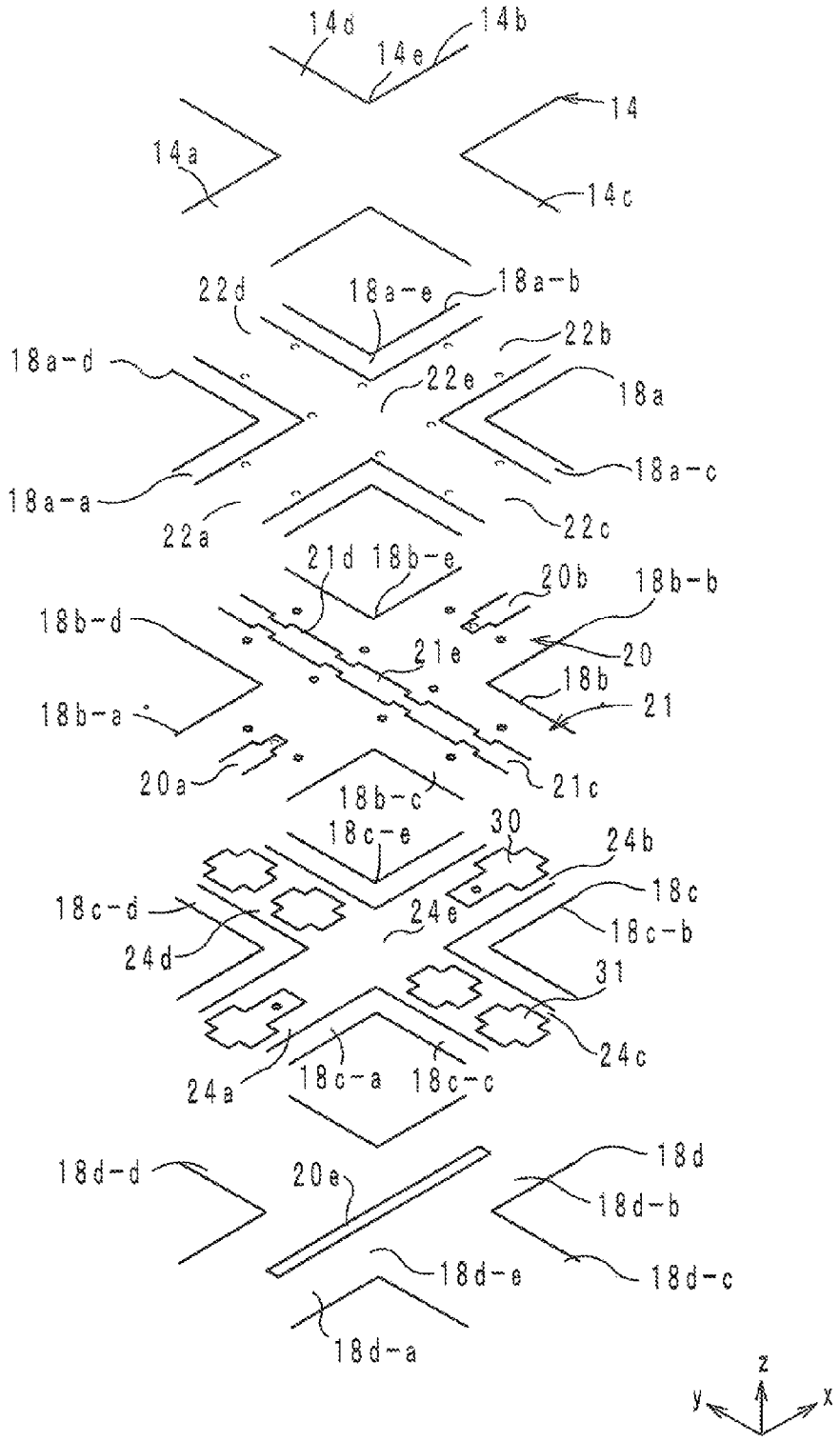
FIG. 20 is an exploded oblique view of a portion E3 of a high-frequency transmission line according to a second modification of a preferred embodiment of the present invention.

Hereinafter, a high-frequency transmission line 10*b* according to a second modification of a preferred embodiment of the present invention will be described with reference to the drawings. FIG. 20 is an exploded oblique view of a portion E3 of the high-frequency transmission line 10*b* according to the second modification. For an external oblique view of the high-frequency transmission line 10*b*, FIG. 1 will be referenced.

The high-frequency transmission line 10*b* differs from the high-frequency transmission line 10*a* in the following aspects. The first difference is that the high-frequency transmission line 10*b* does not include the ground conductor 26. The second difference is that the signal line 21 is positioned in its entirety on the dielectric sheet 18*b*. The third difference is that a dielectric sheet 18*e* is additionally provided, so that the line conductor 20*e* is positioned on the top surface of the dielectric sheet 18*e*. The fourth difference is that the ground conductor 24 is positioned between the line conductors 20*a*, 20*b*, 20*f*, 20*g*, 21*c* to 21*e*, 21*h*, and 21*i* and the line conductor 20*e* in the z-axis direction.

In the high-frequency transmission line 10*b*, the line conductors 20*a*, 20*b*, 20*f*, 20*g*, 21*c* to 21*e*, 21*h*, and 21*i* are positioned on the top surface of the dielectric sheet 18*b* between the ground conductors 22 and 24 in the z-axis direction, as shown in FIG. 20. Moreover, the line conductor 20*e* is positioned on the top surface of the dielectric sheet 18*e*. Accordingly, the portion of the signal line 20 that crosses the signal line 21 (i.e., the line conductor 20*e*) is positioned on the negative side in the z-axis direction relative to the ground conductor 24. Therefore, in the high-frequency transmission line 10*b*, the crossing conductor 24*e* is a portion of the ground conductor 24 that overlaps with the crossing portions of the signal lines 20 and 21.

In the high-frequency transmission line 10*b* thus configured, the crossing conductor 24*e*, which is kept at a ground potential, is positioned between the line conductors 20*e* and 21*e*. That is, the crossing conductor 24*e* functions as an intermediate ground conductor. Thus, as with the high-frequency transmission line 10, the high-frequency transmission line 10*b* renders it possible to significantly reduce or prevent crosstalk between the signal lines 20 and 21.

Furthermore, in the high-frequency transmission line 10*b*, the signal line 21 is positioned in its entirety on the top surface of the dielectric sheet 18*b*, and therefore, does not extend to any dielectric sheet other than the dielectric sheet 18*b* through via-hole conductors or suchlike. Accordingly, the characteristic impedance of the signal line 21 is more resistant to fluctuations. Therefore, the signal line 20 can be used as a signal line with a wider range of allowable fluctuations in characteristic impedance, and the signal line 21 can be used as a signal line with a narrower range of allowable fluctuations in characteristic impedance. Thus, the high-frequency transmission line 10*b* can be configured in accordance with the characteristics required of signal lines.

Furthermore, the high-frequency transmission line 10*b* includes the two ground conductors 22 and 24 but no ground conductor 26. Thus, the high-frequency transmission line 10*b* renders it possible to reduce the number of ground conductors.

Note that in the high-frequency transmission line 10*b*, the line conductor 20*e* of the signal line 20 is positioned on the negative side in the z-axis direction relative to the signal line 21*e* and the intermediate ground conductor (i.e., the crossing conductor 24*e*), but the line conductor 20*e* can be positioned on the positive side in the z-axis direction relative to the signal line 21*e*. In such a case, a crossing conductor to serve as an intermediate ground conductor is provided so as to be positioned on the positive side in the z-axis direction relative to the signal line 21*e* and also on the negative side in the z-axis direction relative to the signal line 20*e*.

Third Modification

Figure 21:
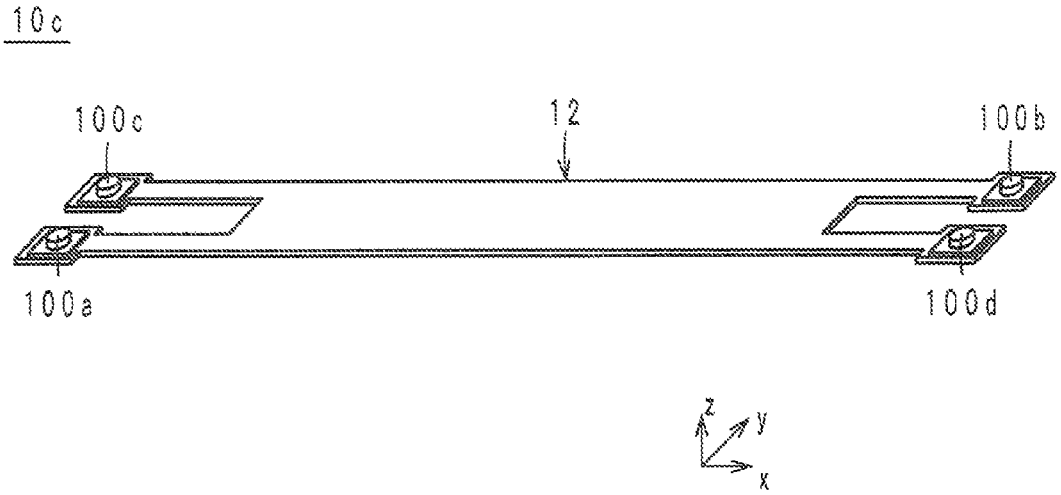
FIG. 21 is an external oblique view of a high-frequency transmission line according to a third modification of a preferred embodiment of the present invention.
Figure 22:
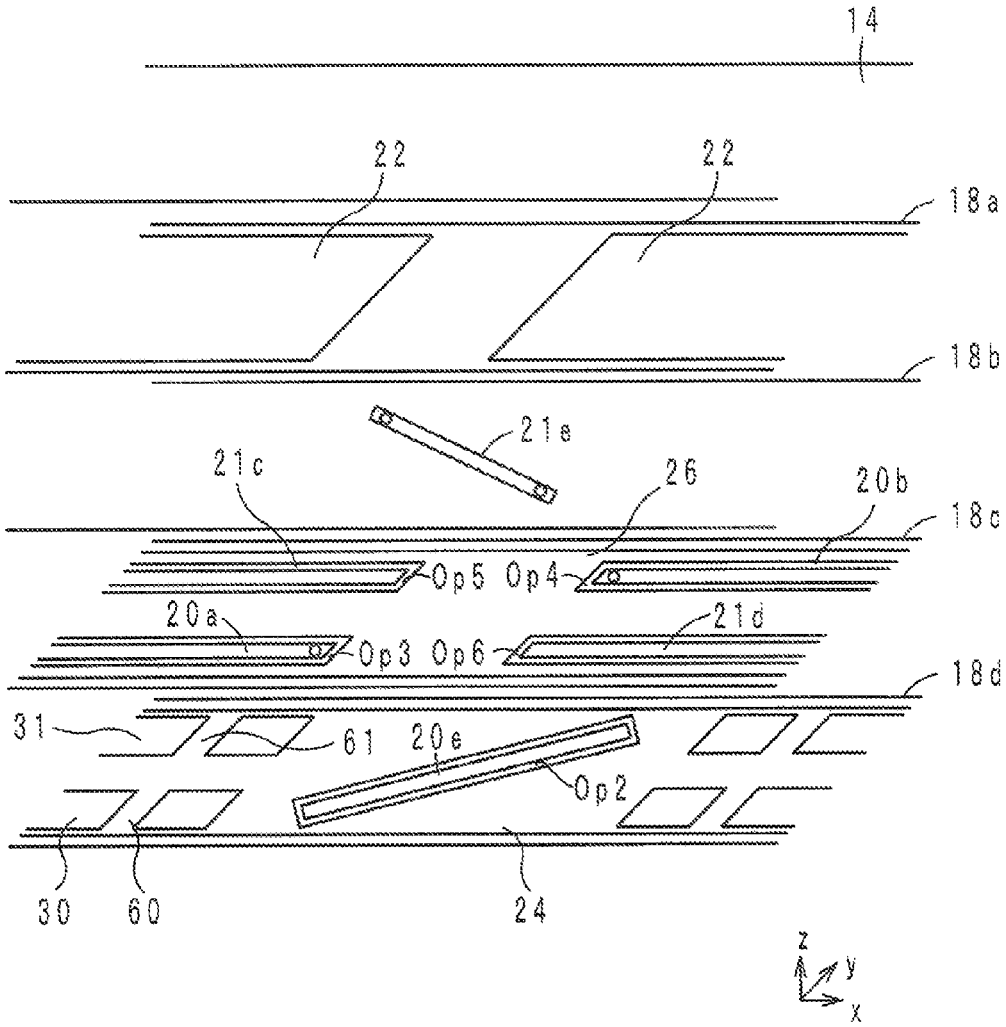
FIG. 22 is an exploded oblique view of the high-frequency transmission line according to the third modification of a preferred embodiment of the present invention.
Figure 23:
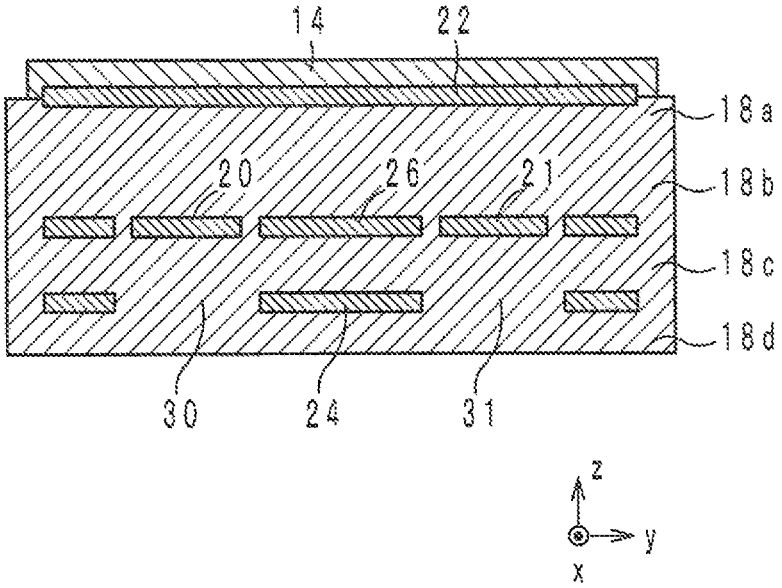
FIG. 23 is a cross-sectional structure view of the high-frequency transmission line according to the third modification of a preferred embodiment of the present invention.

Hereinafter, a high-frequency transmission line 10*c* according to a third modification of a preferred embodiment of the present invention will be described with reference to the drawings. FIG. 21 is an external oblique view of the high-frequency transmission line 10*c* according to the third modification. FIG. 22 is an exploded oblique view of the high-frequency transmission line 10*c* according to the third modification. FIG. 23 is a cross-sectional structure view of the high-frequency transmission line 10*c* according to the third modification.

The high-frequency transmission line 10*c* differs from the high-frequency transmission line 10*a* in that the signal lines 20 and 21 are at least partially parallel or substantially parallel to each other.

The dielectric element assembly 12 extends in the x-axis direction and is divided into two branches at the end on each of the positive and negative sides in the x-axis direction, as shown in FIG. 21. The dielectric element assembly 12 is a flexible laminate preferably formed by laminating the protective layer 14 and the dielectric sheets 18*a* to 18*d* in this order from the positive side to the negative side in the z-axis direction, as shown in FIG. 22. In the following, the principal surface of the dielectric element assembly 12 that is located on the positive side in the z-axis direction will be referred to as a top surface, and the principal surface of the dielectric element assembly 12 that is located on the negative side in the z-axis direction will be referred to as a bottom surface.

The dielectric sheets 18*a* to 18*d*, when viewed in a plan view in the z-axis direction, have the same shape as the dielectric element assembly 12. The dielectric sheets 18*a* to 18*d* preferably are made of a flexible thermoplastic resin such as liquid crystal polymer or polyimide. Each of the dielectric sheets 18*a* to 18*d* preferably has a thickness of, for example, about 25 μm to about 200 μm after lamination. In the following, the principal surface of each of the dielectric sheets 18*a* to 18*d* that is located on the positive side in the z-axis direction will be referred to as atop surface, and the principal surface of each of the dielectric sheets 18*a* to 18*d* that is located on the negative side in the z-axis direction will be referred to as a bottom surface.

The signal line 20 is provided in the dielectric element assembly 12, and includes line conductors 20*a*, 20*b*, and 20*e*, as shown in FIGS. 22 and 23. The line conductors 20*a* and 20*b* are linear conductors positioned on the top surface of the dielectric sheet 18*c*, so as to extend in the x-axis direction. The line conductor 20*a* is positioned on the negative side in the x-axis direction relative to the line conductor 20*b* and also on the negative side in the y-axis direction relative to the line conductor 20*b*.

The line conductor 20*e* is a linear conductor positioned on the top surface of the dielectric sheet 18*d*, and is inclined with respect to the x-axis toward the positive side in the x-axis direction so as to point toward the positive side in the y-axis direction. The end of the line conductor 20*a* that is located on the positive side in the x-axis direction overlaps with the end of the line conductor 20*e* that is located on the negative side in the x-axis direction. In addition, the end of the line conductor 20*a* that is located on the positive side in the x-axis direction is connected to the end of the line conductor 20*e* that is located on the negative side in the x-axis direction by a via-hole conductor. The end of the line conductor 20*b* that is located on the negative side in the x-axis direction overlaps with the end of the line conductor 20*e* that is located on the positive side in the x-axis direction. In addition, the end of the line conductor 20*b* that is located on the negative side in the x-axis direction is connected to the end of the line conductor 20*e* that is located on the positive side in the x-axis direction by a via-hole conductor. The signal line 20 preferably is made of a metal material mainly composed of silver or copper and having a low specific resistance, for example.

The signal line 21 is provided in the dielectric element assembly 12, and includes line conductors 21*c*, 21*d*, and 21*e*, as shown in FIGS. 22 and 23. The line conductors 21*c* and 21*d* are linear conductors positioned on the top surface of the dielectric sheet 18*c*, so as to extend in the x-axis direction. The line conductor 21*c* is positioned on the negative side in the x-axis direction relative to the line conductor 21*d* and also on the positive side in the y-axis direction relative to the line conductor 21*d*. Accordingly, the line conductors 20*a* and 21*c* are parallel or substantially parallel to each other. In addition, the line conductors 20*b* and 21*d* are parallel to each other.

The line conductor 21*e* is a linear conductor positioned on the top surface of the dielectric sheet 18*b*, and is inclined with respect to the x-axis toward the positive side in the x-axis direction so as to point toward the negative side in the y-axis direction. The end of the line conductor 21*c* that is located on the positive side in the x-axis direction overlaps with the end of the line conductor 21*e* that is located on the negative side in the x-axis direction. In addition, the end of the line conductor 21*c* that is located on the positive side in the x-axis direction is connected to the end of the line conductor 21*e* that is located on the negative side in the x-axis direction by a via-hole conductor. The end of the line conductor 21*d* that is located on the negative side in the x-axis direction overlaps with the end of the line conductor 21*e* that is located on the positive side in the x-axis direction. In addition, the end of the line conductor 21*d* that is located on the negative side in the x-axis direction is connected to the end of the line conductor 21*e* that is located on the positive side in the x-axis direction by a via-hole conductor. Moreover, the line conductors 20*e* of the signal line 20 and the line conductor 21*e* of the signal line 21 cross each other when viewed in a plan view in the z-axis direction. The signal line 21 preferably is made of a metal material mainly composed of silver or copper and having a low specific resistance, for example.

The ground conductor 22 is provided in the dielectric element assembly 12 so as to be positioned on the positive side in the z-axis direction relative to the line conductors 20*a*, 20*b*, 21*c*, and 21*d*, as shown in FIGS. 22 and 23, and more specifically, the ground conductor 22 is positioned on the top surface of the dielectric sheet 18*a*. The ground conductor 22, when viewed in a plan view in the z-axis direction, has the same or approximately the same shape as the dielectric element assembly 12, and overlaps with the signal lines 20 and 21. More specifically, the ground conductor 22 overlaps with the signal line 21 at opposite ends of the line conductor 21*e* but not at other portions. The ground conductor 22 preferably is made of a metal material mainly composed of silver or copper and having a low specific resistance, for example.

The ground conductor 24 is provided in the dielectric element assembly 12 so as to be positioned on the negative side in the z-axis direction relative to the line conductors 20*a*, 20*b*, 21*c*, and 21*d*, as shown in FIGS. 21 and 22, and more specifically, the ground conductor 24 is positioned on the top surface of the dielectric sheet 18*d*. The ground conductor 24, when viewed in a plan view in the z-axis direction, has the same or approximately the same shape as the dielectric element assembly 12, and overlaps with the signal lines 20 and 21. More specifically, the ground conductor 24 has an opening Op2 provided therein. The line conductor 20*e* is positioned within the opening Op2. Accordingly, the ground conductor 24 does not overlap with the line conductor 20*e*. The ground conductor 24 preferably is made of a metal material mainly composed of silver or copper and having a low specific resistance, for example.

Here, the ground conductor 24 preferably includes a plurality of rectangular or substantially rectangular openings 30 and a plurality of rectangular or substantially rectangular openings 31 provided therein, as shown in FIG. 22. The openings 30, when viewed in a plan view in the z-axis direction, overlap with the signal line 20, and are arranged along the signal line 20. The openings 31, when viewed in a plan view in the z-axis direction, overlap with the signal line 21, and are arranged along the signal line 21.

The ground conductor 26 is provided in the dielectric element assembly 12 so as to be positioned on the same surface of the dielectric sheet 18*c* on which the line conductors 20*a*, 20*b*, 21*c*, and 21*d* are positioned, as shown in FIGS. 21 and 22. The ground conductor 26, when viewed in a plan view in the z-axis direction, has the same or approximately the same shape as the dielectric element assembly 12. More specifically, the ground conductor 26 includes openings Op3 to Op6 provided therein. In addition, the line conductors 20*a*, 20*b*, 21*c*, and 21*d* are positioned within the openings Op3 to Op6, respectively. Accordingly, the ground conductor 26 does not overlap with the line conductors 20*a*, 20*b*, 21*c*, and 21*d*. The ground conductor 26, when viewed in a plan view in the z-axis direction, is positioned between the line conductors 20*e* and 21*e* in the z-axis direction, so as to overlap with the signal conductors 20*e* and 21*e*. The ground conductor 26 preferably is made of a metal material mainly composed of silver or copper and having a low specific resistance, for example.

The protective layer 14 covers approximately the entire top surface of the dielectric sheet 18*a*. Accordingly, the ground conductor 22 is covered by the protective layer 14. The protective layer 14 is made of, for example, a flexible resin such as a resist material.

The other features of the high-frequency transmission line 10*c* are the same as the high-frequency transmission line 10*a*, and therefore, any descriptions thereof will be omitted.

Figure 24:
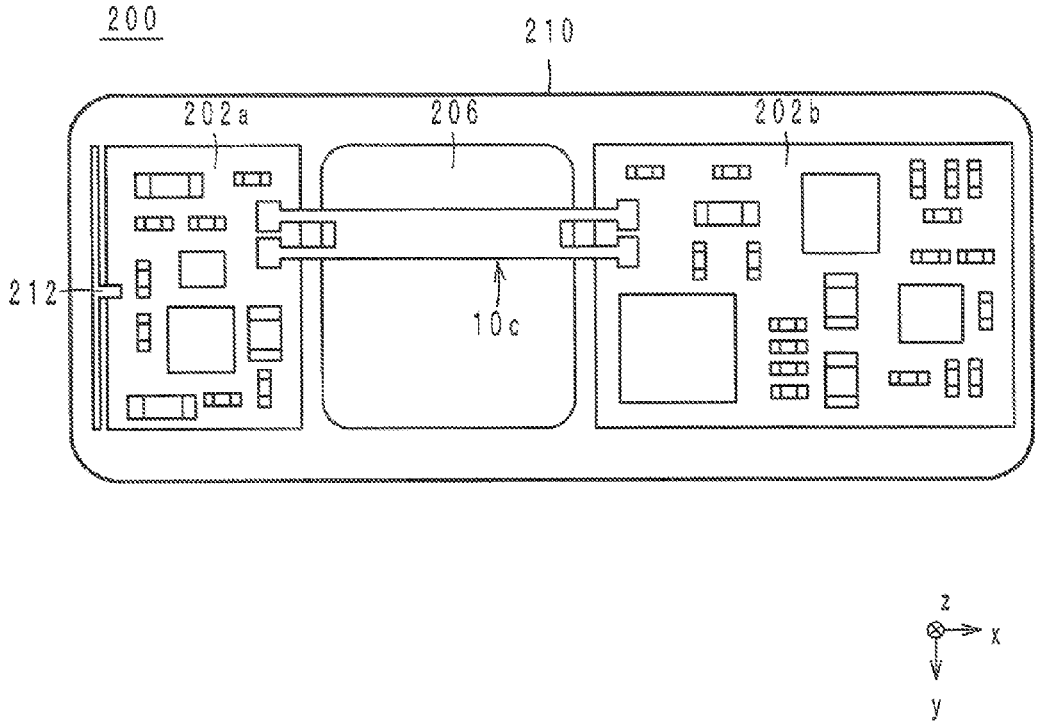
FIG. 24 illustrates an electronic device provided with the high-frequency transmission line as viewed in a plan view in the z-axis direction.

The high-frequency transmission line 10*c* is preferably used in a manner as will be described below. FIG. 24 illustrates an electronic device 200 provided with the high-frequency transmission line 10*c* as viewed in a plan view in the z-axis direction.

The electronic device 200 includes the high-frequency transmission line 10*c*, circuit boards 202*a* and 202*b*, a battery pack (metallic body) 206, a housing 210, and an antenna 212.

The housing 210 accommodates the high-frequency transmission line 10*c*, the circuit boards 202*a* and 202*b*, the battery pack 206, and the antenna 212, as shown in FIG. 24. The circuit board 202*a* includes, for example, a transmission or reception circuit provided thereon. The circuit board 202*b* includes, for example, a power circuit (a radio frequency integrated circuit: RFIC) provided thereon. The battery pack 206 is, for example, a lithium-ion secondary battery, and the surface thereof is wrapped by a metal cover. The circuit board 202*a*, the battery pack 206, and the circuit board 202*b* are arranged in this order, from the negative side to the positive side in the x-axis direction. Moreover, the antenna 212 is connected to the circuit board 202*a*.

The high-frequency transmission line 10*c* connects the circuit boards 202*a* and 202*b*. Moreover, the top surface of the dielectric element assembly 12 (more precisely, the protective layer 14) is in contact with the battery pack 206. The battery pack 206 is fixed on the top surface of the dielectric element assembly 12 by an adhesive or suchlike.

The high-frequency transmission line 10*c* thus configured has the ground conductor 26 provided between the line conductors 20*e* and 21*e*. Therefore, as with the high-frequency transmission line 10*a*, the high-frequency transmission line 10*c* renders it possible to significantly reduce or prevent crosstalk between the signal lines 20 and 21.

Further, the ground conductor 26 is positioned at least partially between the line conductors 20*a* and 21*c* and also between the line conductors 20*b* and 21*d*. Thus, crosstalk between the signal lines 20 and 21 is further significantly reduced or prevented.

Other Preferred Embodiments

The present invention is not limited to the high-frequency transmission lines 10 and 10*a* to 10*c* according to the above preferred embodiments, and variations can be made within the spirit and scope of the present invention.

Further, the configuration of the high-frequency transmission lines 10 and 10*a* to 10*c* may be used in combination, for example.

Note that the electronic device 200 is not limited to mobile communication terminals, such as cell phones, tablet computers, and notebook computers, and encompasses any device including a signal line for high-frequency signal transmission, such as digital cameras and desktop computers.

Further, the high-frequency transmission lines 10 and 10*a* to 10*c* may be used to connect matching circuits for high-frequency signals, rather than to connect antennas and power circuits. In addition, each of the high-frequency transmission lines 10 and 10*a* to 10*c* may be used to connect two high-frequency circuit boards.

Still further, through-hole conductors obtained by plating inner circumferential surfaces of through-holes may be used in the high-frequency transmission lines 10 and 10*a* to 10*c* in place of the via-hole conductors as described above.

Yet further, in the high-frequency transmission lines 10 and 10*a* to 10*c*, the ground conductors 22 and 24 preferably are provided in the dielectric element assembly 12, for example, but they may be provided either on the top surface or the bottom surface of the dielectric element assembly 12.

Note that the high-frequency transmission lines 10 and 10*a* to 10*c* may be used on RF circuit boards such as antenna front end modules.

Further, the connectors 100*a* to 100*d* do not have to be mounted on the high-frequency transmission lines 10 and 10*a* to 10*c*. In such a case, the high-frequency transmission lines 10 and 10*a* to 10*c* are connected at the ends to circuit boards by soldering or suchlike. Alternatively, the connectors 100*a* to 100*d* may be mounted on some ends of the high-frequency transmission lines 10 and 10*a* to 10*c*.

Still further, the connectors 100*a* to 100*d* are mounted on the top surfaces of the high-frequency transmission lines 10 and 10*a* to 10, but they may be provided on the bottom surfaces. Alternatively, for example, the connectors 100*a* and 100*b* may be mounted on the top surfaces of the high-frequency transmission lines 10 and 10*a* to 10*c*, and the connector 100*c* and 100*d* may be mounted on the bottom surfaces of the high-frequency transmission lines 10 and 10*a* to 10*c*.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A high-frequency transmission line comprising:
- a laminate including a plurality of dielectric layers;
- a first signal line provided on one of the dielectric layers;
- a second signal line crossing the first signal line when viewed in a plan view in a direction of lamination, the second signal line being positioned on the same dielectric layer as the first signal line except for a crossing portion that crosses with the first signal line; and
- an intermediate ground conductor provided between the first and second signal lines in the direction of lamination, so as to overlap with crossing portions of the first and second signal lines when viewed in a plan view in the direction of lamination; wherein
- the crossing portion of the first signal line that crosses the second signal line is positioned on a second side in the direction of lamination relative to a portion of the first signal line not crossing the second signal line; and
- the crossing portion of the second signal line that crosses the first signal line is positioned on a first side in the direction of lamination relative to a portion of the second signal line not crossing the first signal line.

2. The high-frequency transmission line according to claim 1, further comprising:
- a first ground conductor positioned on the first side in the direction of lamination relative to portions of the first and second signal lines not crossing each other; and
- a second ground conductor positioned on the second side in the direction of lamination relative to portions of the first and second signal lines not crossing each other.

3. The high-frequency transmission line according to claim 2, wherein openings are provided in the second ground conductor, the first and second signal lines have different widths, and the intermediate ground conductor is provided only at the crossing portions of the first and second signal lines.

4. An electronic device comprising the high-frequency transmission line according to claim 1.

5. The electronic device according to claim 4, wherein the electronic device is one of a phone, a computer and a camera.

6. An electronic device comprising:
- a high-frequency transmission line; and
- a housing accommodating the high-frequency transmission line; wherein
- the high-frequency transmission line includes:
  - a laminate including a plurality of dielectric layers;
  - a first signal line provided on one of the dielectric layers;
  - a second signal line crossing the first signal line when viewed in a plan view in a direction of lamination, the second signal line being positioned on the same dielectric layer as the first signal line except for a crossing portion that crosses with the first signal line; and
  - an intermediate ground conductor provided between the first and second signal lines in the direction of lamination, so as to overlap with the crossing portions of the first and second signal lines when viewed in a plan view in the direction of lamination;
- the crossing on of the inc that crosses the second signal line is positioned on a second side in the direction of lamination relative to a portion of the first signal line not crossing the second signal line; and
- the crossing portion of the second signal line that crosses the first signal line is positioned on a first side in the direction of lamination relative to a portion of the second signal line not crossing the first signal line.

7. The electronic device according to claim 6, wherein the electronic device is one of a phone, a computer and a camera.

8. The electronic device according to claim 6, further comprising:
- a first ground conductor positioned on the first side in the direction of lamination relative to portions of the first and second signal lines not crossing each other; and
- a second ground conductor positioned on the second side in the direction of lamination relative to portions of the first and second signal lines not crossing each other.

9. The electronic device according to claim 8, wherein openings are provided in the second ground conductor, the first and second signal lines have different widths, and the intermediate ground conductor is provided only at the crossing portions of the first and second signal lines.

10. A high-frequency transmission line comprising:
- a laminate including a plurality of dielectric layers;
- a first signal line provided on one of the dielectric layers;
- a second signal line crossing the first signal line when viewed in a plan view in a direction of lamination, the second signal line being positioned on the same dielectric layer as the first signal line except for a crossing portion that crosses with the first signal line;
- an intermediate ground conductor provided between the first and second signal lines in the direction of lamination, so as to overlap with crossing portions of the first and second signal lines when viewed in a plan view in the direction of lamination;
- a first ground conductor positioned on a first side in the direction of lamination relative to portions of the first and second signal lines not crossing each other; and a second ground conductor positioned on a second side in the direction of lamination relative to portions of the first and second signal lines not crossing each other; wherein an overlap of the first signal line with the second ground conductor is smaller in area than an overlap of the first signal line with the first ground conductor;

an overlap of the second signal line with the second ground conductor is smaller in area than an overlap of the second signal line with the first ground conductor; and the portions of the first and second signal lines not crossing each other are less distant from the second ground conductor in the direction of lamination than from the first ground conductor in the direction of lamination.

11. The high-frequency transmission line according to claim 10, wherein the second ground conductor includes a plurality of first openings arranged along the first signal line and a plurality of second openings arranged along the second signal line.

12. An electronic device comprising:

a high-frequency transmission line; and a housing accommodating the high-frequency transmission line; wherein the high-frequency transmission line includes:

a laminate including a plurality of dielectric layers;

a first signal line provided on one of the dielectric layers;

a second signal line crossing the first signal line when viewed in a plan view in a direction of lamination, the second signal line being positioned on the same dielectric layer as the first signal line except for a crossing portion that crosses with the first signal line;

an intermediate ground conductor provided between the first and second signal lines in the direction of lamination, so as to overlap with the crossing portions of the first and second signal lines when viewed in a plan view in the direction of lamination;

a first ground conductor positioned on a first side in the direction of lamination relative to portions of the first and second signal lines not crossing each other; and a second ground conductor positioned on a second side in the direction of lamination relative to portions of the first and second signal lines not crossing each other;

an overlap of the first signal line with the second ground conductor is smaller in area than an overlap of the first signal line with the first ground conductor;

an overlap of the second signal line with the second ground conductor is smaller in area than an overlap of the second signal line with the first ground conductor; and the portions of the first and second signal lines not crossing each other are less distant from the second ground conductor in the direction of lamination than from the first ground conductor in the direction of lamination.

13. The electronic device according to claim 12, wherein the second ground conductor includes a plurality of first openings arranged along the first signal line and a plurality of second openings arranged along the second signal line.

* * * * *